US012435523B2

(12) United States Patent
Boucké

(10) Patent No.: US 12,435,523 B2
(45) Date of Patent: Oct. 7, 2025

(54) DECORATIVE PANEL, AND COVERING OF SUCH DECORATIVE PANELS

(71) Applicant: I4F Licensing NV, Turnhout (BE)

(72) Inventor: Eddy Alberic Boucké, Turnhout (BE)

(73) Assignee: i4F Licensing NV, Turnhout (BE)

( * ) Notice: Subject to any disclaimer, the term of this patent is extended or adjusted under 35 U.S.C. 154(b) by 93 days.

(21) Appl. No.: 18/035,781

(22) PCT Filed: Nov. 8, 2021

(86) PCT No.: PCT/EP2021/080947
§ 371 (c)(1),
(2) Date: May 8, 2023

(87) PCT Pub. No.: WO2022/096712
PCT Pub. Date: May 12, 2022

(65) Prior Publication Data

US 2023/0399856 A1 Dec. 14, 2023

(30) Foreign Application Priority Data

Nov. 9, 2020 (NL) ..... 2026858

(51) Int. Cl.
*E04F 15/00* (2006.01)
*E04F 13/08* (2006.01)
*E04F 15/02* (2006.01)

(52) U.S. Cl.
CPC .... *E04F 15/02038* (2013.01); *E04F 13/0894* (2013.01); *E04F 2201/0146* (2013.01); *E04F 2201/0161* (2013.01); *E04F 2201/023* (2013.01); *E04F 2201/042* (2013.01); *E04F 2201/043* (2013.01)

(58) Field of Classification Search
CPC ..... E04F 15/02033; E04F 15/02038; E04F 15/107; E04F 15/102; E04F 2201/042; E04F 2201/0107; E04F 2201/03; E04F 15/0803; E04F 13/0894; E04F 15/02044; E04F 15/02183; E04F 2015/02161; E04F 2201/0123; E04F 2201/0161; E04F 2201/021; E04F 2201/0552; E04F 2201/023; E04F 2201/0535; E04F 2201/0146; E04F 2201/043;
(Continued)

(56) References Cited

U.S. PATENT DOCUMENTS 9,624,676 B2 4/2017 Thiers et al.
11,352,799 B2 * 6/2022 Boucké ..... B32B 27/08
(Continued)

FOREIGN PATENT DOCUMENTS

DE 202006007411 U1 8/2006
EP 3153640 A1 4/2017
(Continued)

*Primary Examiner* — Chi Q Nguyen
(74) *Attorney, Agent, or Firm* — The Webb Law Firm

(57) ABSTRACT

A decorative panel including at least at a first pair of opposite edges, a first coupling part and a second coupling part allowing that several of such panels can be coupled to each other, whereby the first and second coupling parts, in coupled condition of two of such panels, provide a locking in a first direction perpendicular to a plane of the panels, as well as in a second direction perpendicular to respective edges and parallel to the plane of the panels.

20 Claims, 5 Drawing Sheets

(58) Field of Classification Search
CPC ..... E04F 2201/0547; E04F 2201/0153; E04F 2201/0138; E04F 2290/00
See application file for complete search history.

(56) References Cited

U.S. PATENT DOCUMENTS

| | | | | |
|---|---|---|---|---|
| 11,624,193 | B2 * | 4/2023 | Boucké | B32B 5/18 52/309.17 |
| 11,702,848 | B2 * | 7/2023 | Boucké | E04F 15/102 52/588.1 |
| 11,773,602 | B2 * | 10/2023 | Boucké | B32B 15/08 52/177 |
| 11,788,302 | B2 * | 10/2023 | Nilsson | E04F 15/02038 52/588.1 |
| 12,158,010 | B2 * | 12/2024 | Settels | E04F 15/107 |
| 12,158,011 | B2 * | 12/2024 | Boucké | E04F 13/0894 |
| 2005/0055938 | A1 * | 3/2005 | Secondino | A47F 5/0846 52/506.01 |
| 2005/0108969 | A1 * | 5/2005 | Whitaker | E04F 15/10 52/578 |
| 2008/0072514 | A1 * | 3/2008 | Barlow | E01C 5/22 52/540 |
| 2008/0245020 | A1 | 10/2008 | Kiefel et al. | |
| 2010/0300027 | A1 * | 12/2010 | Bravo | E04F 15/087 52/311.1 |
| 2013/0167458 | A1 * | 7/2013 | Cerny | E04F 15/10 52/177 |
| 2016/0340899 | A1 * | 11/2016 | Piccone | E04B 2/86 |
| 2020/0263439 | A1 | 8/2020 | Nilsson | |

FOREIGN PATENT DOCUMENTS

| | | | |
|---|---|---|---|
| JP | 200427626 | A | 1/2004 |
| JP | 2020524759 | A | 8/2020 |
| WO | 2017122143 | A1 | 7/2017 |
| WO | 2019137964 | A1 | 7/2019 |

* cited by examiner

DECORATIVE PANEL, AND COVERING OF SUCH DECORATIVE PANELS

CROSS-REFERENCE TO RELATED APPLICATIONS

This application is the United States national phase of International Application No. PCT/EP2021/080947 filed Nov. 8, 2021, and claims priority to The Netherlands Patent Application No. 2026858 filed Nov. 9, 2020, the disclosures of which are hereby incorporated by reference in their entireties.

BACKGROUND OF THE INVENTION

Field of the Invention

The invention relates to a decorative panel, in particular a floor panel, wall panel, or ceiling panel. The invention also relates to a covering, in particular a floor covering, a wall covering, or a ceiling covering, composed of a plurality of interconnected decorative panels according to the invention.

Description of Related Art

The last decades has seen enormous advance in the market for flooring for floor covering. It is known to install floor panels on an underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling. The floor obtained in this manner, also called a floating floor, has as an advantage that it is easy to install and that the complete floor surface can move which often is convenient in order to receive possible expansion and shrinkage phenomena. The options and requirements for flooring has evolved as well. Whereas flooring used to be made of wood or wood-derived products, such as MDF or HDF, traditionally also referred to as laminate, lately the market has evolved towards plastic-based panels, like PVC panels and even towards mineral-based panels, like magnesium-oxide based panels. Each of these alternative has their advantages and disadvantages. One of the disadvantages of known panels, irrespective of the material, is that it is often difficult to couple and lock panels together, such that a watertight connection is made between the panels. Water permeating the seams in between the panels may not only affect the panels in case the panels are at least partially made of moisture-sensitive materials, such as MDF and HDF, but may also facilitate microbial growth in between said panels, which is undesired from a hygienic and health point of view.

SUMMARY OF THE INVENTION

It is a first goal of the present invention to provide an improved connection between panels, in particular a waterproof connection between panels.

It is a second goal of the present invention to provide a panel with an improved angling down coupling mechanism, in particular to realize a substantially waterproof connection between panels To this end, the invention provides a decorative panel according to the preamble, comprising, at least at a first pair of opposite edges, a first coupling part and a second coupling part allowing that several of such panels can be coupled to each other, whereby these coupling parts, in coupled condition of two of such panels, provide a locking in a first direction (R1) perpendicular to the plane of the panels, as well as in a second direction (R2) perpendicular to the respective edges and parallel to the plane of the panels, wherein said first coupling part comprises a sideward tongue, wherein said sideward tongue comprises a front region and a back region, wherein a top surface of the front region is preferably at least partially inclined downwardly in a direction away from the back region, and wherein a bottom surface and/or side surface of the back region of said sideward tongue defines a first contact portion, and wherein the sideward tongue comprises a passive bottom surface situated adjacent to the first contact portion, wherein said second coupling part comprises a recess (or groove) for accommodating at least a part of the sideward tongue of a further panel, said recess being defined by an upper lip and a lower lip, wherein the lower lip extends beyond the upper lip, and wherein the lower lip being provided with a upwardly protruding shoulder defining a second contact portion configured to co-act, in particular actively co-act, with said first contact portion of another panel, in coupled condition of said panels, such that that the panels are forced with a force, in particular a tension force (T1), at least laterally towards each other, wherein a top surface of said lower lip is curved, in particular smoothly curved, at least partially, and wherein said at least partially curved top surface of the lower lip and said passive bottom surface of the sideward tongue are mutually situated such that, in coupled condition of two panels, an intermediate space is present adjacent to actively co-acting first and second contact portions, and wherein a lower surface of the upper lip is preferably at least partially inclined and configured to abut at least a part of the top surface of the front region of the sideward tongue of another panel.

During installation, a panel to be installed is typically held in tilted state against an already installed panel, wherein the sideward tongue of the panel to be installed is partially inserted in the recess of the already installed panel, after which the panel to be installed in angled in downward direction, as a result of which the sideward tongue will be clamped into the recess. This clamping effect causes the seam formed in between panels to be tightly closed, which impedes water to penetrate into the seam. The way of coupling, by angling down a panel to be installed, is also referred to as an angling down coupling. Depending on the height of the shoulder, the coupling parts may also be configured to slide—substantially within a plane of the panel—and snap a coupling part of a first panel into a coupling part of a second panel. This way of coupling is also referred to as a lateral snap movement. Preferably, at least a part of the top surface of the shoulder, and more preferably the substantially entire top surface of the shoulder, is oriented horizontally. Preferably, a lower surface of the first coupling part, typically positioned adjacent to the sideward tongue, which faces the shoulder in coupled condition of adjacent panels is at least partially, and preferably entirely, oriented horizontally. Preferably, the shoulder and said opposing facing lower surface mutually enclose a space in coupled condition of adjacent panels, which will typically facilitate coupling.

The panel according to the invention realizes a (tension) force between panels in a relatively effective manner by the combination of co-acting contact portions and an adjoining intermediate space, allowing the contact portions to push the panels towards each other and to close the seam in between the panels as firmly and watertightly as possible. Without said intermediate space adjoining the contact portions, in coupled condition of said panels, it will be either practically impossible to couple the coupling part and/or it less tension force will be realized which would lead to a less (water)tight seam in between (the top surfaces of) the panels.

Preferably, a bottom surface and/or a side surface of said front region are rounded and/or convex at least partly. This typically facilitates the insertion of the sideward tongue into the recess as the outer end, also referred to as the nose, of the sideward tongue act as sliding surface during coupling. The bottom surface and/or side surface of said front region of the sideward tongue may at least partially be formed by the same surface. Preferably, the rounded shape of the nose of the sideward tongue is a smoothly rounded shape, which means without sharp edges or other discontinuities As mentioned above, in coupled condition of two panels, the passive bottom surface is facing, at a distance, the top surface of the lower lip, which allows the contact portions to realize the desired pretension between the panels. Here, it is typically preferred that said passive bottom surface is defined by a cut-out portion at a lower side of the sideward tongue, which more preferably results in a substantially flat passive bottom surface. Preferably, the at least partially rounded (section of the) top surface of the lower lip is configured as sliding surface for sliding co-action with the—preferably rounded—bottom surface and/or side surface of the front region of the sideward tongue, during coupling of two panels. Preferably, at least a part of the top surface of the lower lip is smoothly curved, which means without sharp edges or other discontinuities. This will facilitate the coupling process. Preferably, at least a part of the top surface of the lower lip is smoothly curved according to a substantially constant radius. An additional advantage of this embodiment is that the coupling parts are relatively easy and practical to produce compared to more complicated coupling parts.

Preferably, the substantially entire top surface of the lower lip is smoothly curved according to a substantially constant radius. This will typically facilitate sliding in of the sideward tongue into the recess during coupling of adjacent panels. Moreover, such a constant radius could be realized by making use of a single milling tool, which is favourable from an economical and efficiency point of view.

Preferably, the side surface of the front region of the sideward tongue and a facing part of the top surface of the lower lip are substantially complementary shaped, and preferably substantially complementary curved. This allows the sideward tongue to be design as robust as possible, while minimizing the amount of cut-out material to design the recess which prevents unnecessary weaking of the second coupling part. Preferably, the side surface of the front region of the sideward tongue and a facing part of the top surface of the lower lip are at least partially spaced apart and mutually enclose a (front) space. Preferably, the front space is smaller than a bottom space defined by the passive bottom surface of the sideward tongue and a facing part of the top surface of the lower lip. Preferably, the maximum distance a between the side surface of the front region of the sideward tongue and a facing part of the top surface of the lower lip is smaller than the maximum distance b between the passive bottom surface of the sideward tongue and a facing part of the top surface of the lower lip.

Preferably, as mentioned above, a lower surface of the upper lip is downwardly inclined towards a core of the panel, and a top surface of the front region of the sideward tongue is also downwardly inclined in a direction away from said core of the panel. The inclination angles may be the same here. Each inclination angle is preferably situated between (and including) 20 and 30 degrees with respect to the plane defined by the panel. This inclination may considerably facilitate the coupling process and to realize that the panels are entirely coupled in-plane. Moreover, this inclined orientation may contribute to increasing the tension force between the panel, as, in coupled condition, pretension between the lower surface of the upper lip and the upper surface of the front region of the sideward tongue may be present, which pretension may be transferred to the contact portions and/or to substantially vertical contact surfaces defined the seam in between two panels.

The decorative panel according to the invention is primarily intended for indoor use, but may optionally also be used outdoor. The decorative panels according to the invention typically have a limited thickness (20 millimetre or less) and are configured to be installed as floating (floor) covering, preferably without using glue, and which in particular are intended for being used in homes, offices, shops and the like. In particular, hereby applications in so-called laminated floors are intended, wherein a—typically water impermeable (waterproof)—decorative top structure is applied onto a core layer of the panel. Often these core layer is made of wood, wood-based material, particle board, and/or fibreboard, such as medium-density fibreboard (MDF) or high-density fibreboard (HDF). However, alternative materials, like thermoplastic material, in particular polyvinylchloride (PVC) and/or polyurethane (PU), and/or mineral, such as calcium carbonate and/or magnesium (hydr)oxide and/or calcium (hydr)oxide, may also be used to compose the core layer(s) at least partially. Possibly, a sliding agent, for example, paraffin, oil, wax, or the like may be provided on said contact portions of the decorative floor panels to facilitate coupling and possibly, also the make the coupling parts more water repellent which could be in favour of realizing a watertight connection between the coupling parts.

Further preferred embodiments of the panel according to the invention are presented below.

As mentioned above, preferably, the passive bottom surface is at least partially flat or flattened, which is easy to realize during production and which secures the presence of the intermediate space. It is imaginable that the, preferably flat, passive bottom surface is at least partially inclined in a direction towards the front region, with respect to the plane of the panel. Here, the inclined top surface of the sideward tongue and the inclined passive bottom surface preferably converge in a direction away from the back region of the sideward tongue. The enclosed angle of inclination between the inclined top surface of the sideward tongue and the inclined passive bottom surface is preferably less than 15 degrees, more preferably less than 10 degrees, and may be e.g. 5 degrees. This will lead to a relatively lean nose of the sideward tongue, while allowing to keep the back region of the sideward tongue relatively robust, which will lead to a firm tongue which can be inserted relatively easily into the recess. For sake of completeness, it is noted that the passive bottom surface does not necessarily have to be a flat surface, and may, for example, also be a concave surface and/or convex surface and/or a profiled surface, provided that the intermediate space is formed in coupled condition of two panels.

Preferably, the top surface of the lower lip defines a deepest point of the recess, and, in coupled condition of two panels, said deepest point is positioned at a distance from, and facing, the passive bottom surface. This implies that, in case the nose of the sideward tongue is slid over the top surface of the lower lip during coupling towards its final locking position, the nose is initially moved (slid) in downward direction and subsequently in upward direction, which makes it easier to position the nose of the sideward tongue rightfully and to allow the lower surface of the upper lip and the upper surface of the front region of the sideward tongue to abut against each other.

Preferably, the top surface of the lower lip defines a deepest point of the recess, wherein the shoulder of the lower lip defines a highest point of the lower lip, wherein said deepest point and highest point define a lower lip depth (LLD), and wherein the first and second contact portions are entirely located above half (i.e. 50% of) the lower lip depth. It is commonly preferred to situate the contact portions as high as possible to allow the contact portions to efficiently transfer to a clamping force between said contact portions to substantially vertical contact surfaces of two panels defining the seam formed in between the panels.

In a preferred embodiment, the top surface of the lower lip defines a deepest point of the recess, wherein the shoulder of the lower lip defines a highest point of the lower lip, wherein said deepest point and highest point define a lower lip depth (LLD), and wherein the smallest thickness (STD) of the sideward tongue, measured between the at least partially inclined upper surface and the passive bottom surface of the sideward tongue exceeds the lower lip depth. This means that the thickness of the sideward tongue is relatively thick compared to the lower lip depth, which also means that a part of the sideward tongue is positioned above the shoulder (level) of the lower lip. Typically, this leads to more robust, and hence less vulnerable, coupling parts of the panel according to the invention.

Preferably, the first contact portion is inclined upwardly in a direction away from the front region of the sideward tongue, wherein the inclined first contact portion and the plane of the panel preferably encloses an angle of at least 45 degrees, and wherein the second contact portion is inclined upwardly in a direction away from the upper lip, wherein the inclined second contact portion and the plane of the panel preferably encloses an angle of at least 45 degrees. These inclination angles typically have a sufficiently large horizontal component (parallel to the plane of the panel) to realize sufficient tension force to realize a (water)tight connection between the panels. Although the first contact portion and the second contact portion may extend in (slightly) different direction, it is commonly preferred that the first contact portion and the second contact portion extend in a substantially parallel direction. This parallel inclination will commonly facilitate to slide the second contact portion over the first contact portion during installation of the panels.

Preferably, the bottom surface and/or side surface of the front region of the sideward tongue is configured to co-act with the lower lip in coupled condition of two panels, and together define a bottom front contact surface. This bottom front contact surface typically provides (additional) stability and (additional) locking of the coupling parts in coupled condition. Preferably, the entire bottom front contact surface is located underneath the level of the first and second contact portions. This results in a situation wherein the sideward tongue has a tilted orientation (tilted heartline), both in coupled and uncoupled condition, which is efficient to clamp the sideward tongue in between the lower lip and upper lip. Moreover, this positioning of the bottom front contact surface could increase the clamping force between the contact portion and consequently the clamping forces between the substantially vertical contact surfaces at or near the top surface of adjacent panels. Preferably, the bottom front contact surface on one side and the contact surface defined by the first and second contact portions on the other side mutually enclose an angle of between 70 and 110 degrees, preferably between 80 and 100 degrees, more preferably substantially 90 degrees (+/−2-3 degrees). A larger angle typically affects the clamping effect of the sideward tongue, while a smaller angle will typically impede coupling of the coupling parts.

Typically, the (upper) seam formed by (or in between) two panels in coupled condition defines a vertical plane (VP). This vertical plane is perpendicular to the plane of the panel. Preferably, said vertical plane subdivides the lower lip into an inner lower lip part and an outer lower lip lower part. Preferably, at least a part of, and more preferably the entire, (abovementioned) bottom front contact surface as well as the first and second contact portions are situated at the same side of the vertical plane. This results in a relatively large distance and/or an inclined orientation between, on the one side, the second contact portions, defined by the lower surface of the upper lip and an abutting part of the top surface of the front region of the sideward tongue of another panel, and, on the other side, the bottom contact surface, which facilitates coupling and locking of adjacent panels. Typically the upper lip is entirely situated at the same side of the vertical plane. The upper surface of the front region of the sideward tongue preferably intersects the vertical plane (VP). Here, the largest part of said upper surface is positioned underneath (and more preferably contacting) the lower surface of the upper lip. The entire top surface (portion) of the lower lip which extends in between said vertical plane (VP) and the second contact portion is preferably formed by a smooth curved surface, which is more preferably configured to act as sliding surface to facilitate coupling.

Preferably, the seam formed by two panels in coupled condition defines a vertical plane (VP), wherein said vertical plane subdivides the lower lip into an inner lower lip part and an outer lower lip lower part, and wherein, in coupled condition, the entire bottom surface and the entire side surface (in case these surfaces are distinctive surfaces) of the inner lower lip part are positioned at distance from the second coupling part, in particular the sideward tongue. The upper surface of the lower lip is (more) preferably provided with a staggered portion and/or cut-out portion (and/or step-like portion), which is at least partially located underneath the upper lip, and which is configured to accommodate a terminal portion of the sideward tongue of another panel. This staggered portion and/or cut-out portion may create a desired space in between the nose of the sideward tongue and an upper surface of the lower lip, which may not only facilitate coupling, but which also allows the sideward tongue to expand somewhat during normal use, due to e.g. the moisture absorption and/or upon heating. Preferably, the upper lip and the staggered and/or cut-out portion of the lower lip are configurated to clamp the terminal portion (i.e. the nose) of the sideward tongue. This may further intensify the locking effect between the coupling parts. Preferably, the staggered portion and/or cut-out portion and/or step-like portion is entirely positioned underneath the upper lip as this is normally the location the nose of the sideward tongue will be positioned in coupled condition.

Preferably, the top surface of the lower lip comprises a curved back top surface and a curved front top surface, wherein the back top surface and the front top surface are staggered with respect to each other, and wherein preferably the front top surface is deepened with respect to the back top surface. The curvatures of the back top surface and the front top surface may mutually vary, but are preferably substantially identical to each other. Due to the staggered orientation the fictive centers of the curvatures of the front top surface and the back top surface do not coincide and a mutually spaced. Since, the back top surface and front top surface is preferably deepened with respect to the back top surface, which is typically realized by means of cutting out (milling out) additional material during production, slightly more space will be created for accommodating the outer end (the tip) of the sideward tongue. As indicated above, the transition between the front top surface and the back top surface is preferably realized by means of a step(-like portion).

Preferably, the panel defines a top surface and a bottom surface, together defining the thickness (PT) of the panel. The thickness (or height) of the shoulder (ST), as measured from the bottom surface of the panel to the highest point of the shoulder, exceeds 30%, preferably 50%, of the panel thickness (PT). As explained above, by applying a relatively thick (or high) shoulder, the contact portions can be positioned at a higher level, which is beneficial for efficiently transferring the clamping force from the contact portions to the upper seam formed in between the panels, and hence which will lead to a relatively tight connection between the panels at said upper seam.

In coupled condition of the panels, a top surface of the shoulder is preferably positioned at a distance from a facing lower surface of the first coupling part. This prevents the top surface of the shoulder and said opposite, facing lower surface of the first coupling part co-act with each other which could affect the desired tension force in between the panels. Hence, this means that the contact portions are enclosed by two spaces, the intermediate space referred to above and the space above the shoulder. Preferably, a top surface of the shoulder is substantially parallel to the plane of the panel. Preferably, the opposite facing lower surface of the second coupling part is also substantially parallel to the plane of the panel. In this manner, both components can be realized in a relatively robust manner without creating a weak zone in the shoulder and/or in the opposite lower surface of the second coupling part.

The lower lip is preferably entirely located underneath (i.e. at a lower level compared to) the upper lip. This facilitates insertion of the sideward tongue into the recess.

Preferably, the upper surface of the front region of the sideward tongue and a side surface of the front region of the sideward tongue are connected by means of a transitional convex surface and/or the lower surface of the upper lip and a side surface of the upper lip are connected by means of a transitional convex surface. These one or more convex surfaces may act as sliding surface during coupling of the coupling parts, in particular during lateral snap movement.

In the decorative panel according to the invention may the first coupling part and the second coupling part are also provided at least at a second pair of opposite edges. This means that all panel edges are configured to be coupled according to an angling down movement. This design of different first coupling parts at different panel edges may be identical, though may also be different; the same applies to the different second coupling parts. For example, in case of oblong (rectangular) panels, it is imaginable that at the short edge(s) the shoulder thickness is lower or higher than the shoulder thickness at the long edge(s), and the same may apply to other components of the coupling parts. Such a panel is also referred to as an angle-angle panel, which works but which may not be easy to install. Hence, it is commonly preferred that the panel comprises, at least at a further, in particular second, pair of opposite edges, a third coupling part and a fourth coupling part allowing that several of such panels can be coupled to each other by means of a lowering or vertical motion, whereby these coupling parts, in coupled condition of two of such panels, provide a locking in a first direction (R1) perpendicular to the plane of the panels, as well as in a second direction (R2) perpendicular to the respective edges and parallel to the plane of the panels, wherein the third coupling part comprises an upward tongue, at least one upward flank situated at a distance from the upward tongue and an upward groove formed in between the upward tongue and the upward flank, wherein the upward groove is adapted to receive at least a part of a downward tongue of the fourth coupling part of another panel, wherein the side of the upward tongue facing the upward flank is the inside of the upward tongue and the side of the upward tongue facing away from the upward flank is the outside of the upward tongue, wherein the fourth coupling part comprises a downward tongue, at least one downward flank situated at a distance from the downward tongue, and a downward groove formed in between the downward tongue and the downward flank, wherein the downward groove is adapted to receive at least a part of the upward tongue of the third coupling part of another panel, wherein the side of the downward tongue facing the downward flank is the inside of the downward tongue and the side of the downward tongue facing away from the downward flank is the outside of the downward tongue. Preferably, the inside of the upward tongue and the inside is configured to co-act with the inside of the downward tongue of another panel, in coupled condition of said panels, such that that the panels are forced with a tension force (T2) at least laterally towards each other. The tension force (T2) contributes to realise a firm and preferably watertight coupling between the third and fourth coupling parts.

Preferably, at least a part of the inside of the upward tongue is inclined towards the upward flank, and wherein at least of part of the inside of the downward tongue is inclined towards the downward flank. This "closed groove" coupling mechanism could allow two panels to be locked in the first direction (R1). In an alternative embodiment, at least a part of the inside of the upward tongue is inclined away from the upward flank, and wherein at least of part of the inside of the downward tongue is inclined away from the downward flank. This "open groove" coupling mechanism typically allows that the third and fourth coupling part could be connected more easily.

Preferably, the outside of the upward tongue is provided with a first locking element, and wherein the downward flank is provided with a second locking element configured for co-action with the first locking element of another panel. This would allow two panels to be locked in the first direction (R1). The first locking element preferably comprises an outward bulge and the second locking element preferably comprises a recess, wherein the outside of the outward bulge comprises an upper portion and an adjoining lower portion, wherein the lower portion comprises an inclined locking surface and the upper portion comprises a, preferably curved, guiding surface, wherein said recess comprises an upper portion and an adjoining lower portion, wherein the lower portion comprises an inclined locking surface, wherein, in coupled condition of adjacent panels, the inclined locking surface of the lower portion of the outward bulge and the inclined locking surface of lower portion of the recess are in contact to realise said locking effect between the panels and/or wherein, in coupled condition of adjacent panels, the upper portions of the first locking element and the second locking element are preferably spaced apart at least partially. Preferably, the length of the inclined locking surface of the lower portion of the outward bulge is larger, preferably at least 1.5 times larger, than the inclined locking surface of the lower portion of the recess. Preferably, the upper portion extends over a larger vertical section compared to the lower portion, wherein, preferably, the height of the upper portion is at least three times the height of the lower portion.

The first locking element, on the outside of the upward tongue will, during coupling, encounter the downward flank of another panel, as it is the protruding portion of the panel, and typically is the outermost portion of the panel on one side and forces need to be overcome during coupling to force one panel into the other. By providing a (curved) guiding surface on the upper portion, the further or other panel is guided downwards, such that coupling may occur gradually and large material deformations and/or peak stresses can be prevented. The lower portion may thus be inclined, and forms the portion of the bulge which from the outermost part of the bulge returns towards the upward tongue. Also this inclined surface provides a guiding function, guiding the panels towards their final stage. The inclination of the locking surface further allows that a potential upward force or motion of the panels results in a vertical and horizontal force component. The horizontal component may be used to keep the panels together, forcing the panels towards each other, to improve the connection and the waterproof properties of the connection between the panels. The second locking element may be a recess comprising an upper portion and an adjoining lower portion, wherein the lower portion comprises an inclined locking surface, in order to co-act with the first locking element. The inclined surfaces further have the advantage, for instance over rounded surfaces, that they are relatively easy to make or mill, and that it is relatively easy to allow relatively large contact surface between the two to spread out locking forces in coupled panels.

The upper portion may extend over a larger vertical section compared to the lower portion, to gradually guide panels into place. The upper portion typically does not provide a vertical locking effect, such that the horizontal portions thereof are of less relevance compared to the lower portion, which typically does provide a vertical locking effect. The parts of the first and second locking element that are in contact, in coupled condition of the panels, are typically formed by the inclined locking surfaces of the locking elements, so by the lower portions. In coupled condition of the panels the upper portions of the first and second locking elements may be spaced apart at least partially. This spacing allows the upward tongue to move upwardly without being hindered by the downward flank, which upward movement may in turn be transferred and translated into a closing horizontal movement to improve the connection or locking of the panels, forcing the panels together.

The outside of the upward tongue may comprise an upper outside portion and a lower outside portion, wherein the first locking element is arranged between the upper and lower outside portion, wherein the lower outside portion is arranged closer to the inside of the upward tongue compared to the upper outside portion. The upper outside portion may preferably be substantially vertical and defines an outer vertical plane, wherein the first locking element protrudes from the outer vertical plane at least partially, preferably maximally 2 mm. For example, the upper outside portion above the first locking element defines a vertical plane and the lower outside portion beneath the first locking element defines another vertical plane, which are parallel but offset, with the vertical plane of the lower outside portion being located closer to the upward flank. This difference creates a relative large distance between the panels at the intersection between the inclined locking surface of the upward tongue and the lower outside portion, which allows for a larger upward angling or rotational movement of the upward tongue and thus for a potential larger closing or tension force exerted by the locking elements to improve the connection and waterproof properties of the panels.

The lower outside portion may be substantially vertical and the inclined locking surface or the lower portion and the lower outside portion enclose an angle between 100 and 175 degrees, in particular between 100 and 150 degrees, more in particular between 110 and 135 degrees. Such angle has proven to provide the best combination of locking and guiding properties. The angle enclosed by the upper contact surfaces and the inclined contact surfaces and the angle enclosed by the lower outside portion and the inclined locking surface or the lower portion may be within 20 degrees difference, and is preferably the same. This allows for a relative easy manufacture wherein the same or similar tooling may be used to mill both elements from a panel.

An outermost portion of the first locking element may be arranged at a horizontal level which is lower compared to the upward groove. This way, during the downward motion of the panels during coupling, the widest or outermost portion of the first locking element is encountered relatively late, which facilitates coupling of two panels.

Adjoining, and typically directly adjoining or directly below, the upper contact surfaces an inclined contact surface may be present. At the inclined surfaces the panels are in contact, to create a connection or seal between the panels. The inclination is preferably such that, looking at the downward tongue, the inclined surface extends outwardly and, looking at the upward flank, the inclined surface extends inwardly. The inclination angle makes it such that the downward tongue thus has a protruding portion and the upward flank has a recessed portion, which in coupled condition are in contact and thus provide a vertical locking effect. The inclination also creates a slight labyrinth, which improves the waterproof properties of the connection.

Adjoining, and typically directly adjoining or directly below, the inclined contact surface the downward tongue may comprise an outer surface. This outer surface may for instance be the outermost surface of the downward tongue, or the surface of the outer tongue the furthest from the downward flank. Similarly adjoining, and typically directly adjoining or directly below, the inclined contact surface the upward flank comprises an inner surface. Between the inner surface and the outer surface, a space is present. This space aims to prevent that any force exerted on or by the panels results in pushing the panels together anywhere else than at the upper contact surfaces and/or inclined contact surfaces. If the inner and outer surfaces would be in contact, they could prevent the upper contact surfaces to contact, which would be detrimental to the waterproof properties of the connection. At the top, at the upper contact surfaces and the inclined contact surfaces, the aim is thus to create a connection between the panels, whereas below these contact surfaces the aim is to avoid such connection.

The upper contact surfaces may at least partially be vertical and define an inner vertical plane, wherein the inclined contact surface of the downward tongue extends beyond the inner vertical plane, preferably by maximally 1 mm in horizontal direction, and wherein the inclined contact surface of the upward flank lies inward compared to the inner vertical plane. Such configuration is such that the downward tongue locally protrudes from the inner vertical plane, and the upward flank is locally recessed, wherein in coupled condition the inclined contact surfaces may grip behind each other to create a vertical locking effect. By limiting the horizontal extent of the protrusion, the downward tongue can still be coupled with a downward or vertical motion whilst providing the vertical locking effect. A portion of the downward tongue may thus extend beyond the inner vertical plane, which portion may be elongated with a larger vertical portion compared to the horizontal portion, wherein preferably the vertical portion is at least 3 times the horizontal portion. This allows for a relatively small horizontal portion, such that the panels can still be connected with a vertical or downward motion.

A portion of the downward tongue may thus extend beyond the inner vertical plane, wherein said portion may be substantially trapezium-shaped or wedge-shaped. Such shape allows that the portion, when under any locking, coupling or other force in the plane of the panels, is wedged into the space provided in the upward flank while also providing a robust portion able to withstand forces, to create a tight connection between the panels. This in turn improves the waterproof properties of the connection between the panels.

The inclined contact surfaces may both be arranged outside and/or adjoining the inner vertical plane, and are preferably completely arranged outside the inner vertical plane or located entirely on one side of the inner vertical plane. This allows for a relative simple construction which provides a tight connection between two panels. Preferably the upper contact surfaces, which define the vertical plane, directly transition into the inclined contact surfaces. In such configuration the connection, of the contact surfaces continue from the upper contact surfaces to the inclined contact surfaces, increasing the uninterrupted surface thus improving the connection between the panels and the waterproof properties of the connection.

In coupled condition a bottom of the downward tongue may contact the upper side of the upward groove at a groove contact surface, and wherein a gap is present between the first and second coupling parts, extending from the inclined contact surfaces to the groove contact surface. Such gap may be used to collect for instance dust or shavings from the panels, potentially created during coupling of two panels. Additionally such gap aims to prevent that any force exerted on or by the panels results in pushing the panels together anywhere else than at the upper contact surfaces and/or inclined contact surfaces. The groove contact surface is preferably mainly horizontal, and allows for forces exerted on the panel, and in particular on the connection between two panels, typically in downward direction by stepping on the panel, to be transferred to the subfloor or surface beneath the panels.

An upper surface of the upward tongue and an upper surface of the downward groove may, in coupled condition, be distanced from each other such that a gap is present between the two surfaces. Again, such gap aims to prevent that any force exerted on or by the panels results in pushing the panels together anywhere else than at the upper contact surfaces and/or inclined contact surfaces. An upward motion of the upward tongue may for instance result in a horizontal force which closes or tightens the connection between two panels, more in particular in so called closed groove locking connections. To allow this upward motion, the gap is provided between the upward tongue and the downward groove. The upper surface of the downward groove may for instance be formed by the bottom surface of a bridge portion connecting the downward tongue to the rest of the panel The upper contact surface and the inclined contact surface of the upward flank may mutually enclose a first angle, and the upper contact surface and the inclined contact surface of the downward tongue may mutually enclose a second angle, wherein the first and second angle are within 20 degrees difference. For example, the inclined contact surface of the upward flank may mutually enclose a first angle of 120 degrees, and the upper contact surface and the inclined contact surface of the downward tongue may mutually enclose a second angle of 125 degrees. The difference between the two angles is 5 degrees which is within 20 degrees as it is less than 20 degrees. By creating a difference between the angles, a configuration maybe provided wherein a wedging action may be achieved, to increase locking forces and waterproof properties in the connection. Pushing or wedging the locking elements into each other may result in increase in the locking forces or connections in the panels.

Preferably, the upward flank and the outside of the downward tongue define substantially vertical upper contact surfaces of the panel, and wherein adjoining the upper contact surfaces both the downward tongue and the upward flank comprise an inclined contact surface, wherein the inclined contact surface of the downward tongue of said panel is configured to engage the inclined contact surface of the upward flank of an adjacent panel, in coupled condition of said panels, wherein each substantially vertical upper contact surface and each adjoining inclining surface mutually enclose an angle (a) between 100 and 175 degrees. Preferably, the outside of the downward tongue is provided with a third locking element, such as a bulge or recess, and wherein the upward flank is provided with a fourth locking element, such as a recess or bulge, configured for co-action with the third locking element of another panel, allowing two panels to be locked in the first direction (R1). More preferably, the third locking element is at least partially defined by the upper contact surface of the downward tongue, and wherein the fourth locking element is at least partially defined by the upper contact surface of the upward flank.

Preferably, at least a part of each of the coupling parts makes integral part of a core layer of the panel. In other words, side surface of the core may be shaped/profiles such that these profiled edges form the coupling parts at least partially. Preferably, the panel comprises at least one core layer, and at least one decorative top structure or decorative top section, directly or indirectly affixed to said core layer, wherein the top structure or top section defines a top surface of the panel. Typically, this top structure (or top section) is water impermeable, and hence protects the core, which may or may not be composed of a moisture-sensitive material composition, against water (and other liquids). Preferably, the top section comprises a printed decorative layer, and at least one wear layer covering said printed decorative layer. Due to the improved water resistance of the coupling parts, including the first coupling part and second coupling part, this allows the one or more core layers to be at least partially composed of a moisture-sensitive material, such as wood, medium-density fibreboard (MDF) or high-density fibreboard (HDF).

The panels may comprise a layered structure, comprising for instance a central core (or core layer) and at least one decorative top section, directly or indirectly affixed to said core layer, or integrated with said core layer, wherein the top section defines a top surface of the panel. The top section preferably comprises at least one decorative layer affixed, either directly or indirectly, to an upper surface of the core layer. The decorative layer may be a printed layer, such as a printed PVC layer, a printed PU layer or a printed paper layer, and/or may be covered by at least one protective (top) layer covering said decorative layer. The protective layer also makes part of the decorative top section. The presence of a print layer and/or a protective layer could prevent the tile to be damaged by scratching and/or due to environmental factors such as UV/moisture and/or wear and tear. The print layer may be formed by a film onto which a decorative print is applied, wherein the film is affixed onto the substrate layer and/or an intermediate layer, such as a primer layer, situated in between the substrate layer and the decorative layer. The print layer may also be formed by at least one ink layer which is directly applied onto a top surface of the core layer, or onto a primer layer applied onto the substrate layer. The panel may comprise at least one wear layer affixed, either directly or indirectly, to an upper surface of the decorative layer. The wear layer also makes part of the decorative top section. Each panel may comprise at least one lacquer layer affixed, either directly or indirectly, to an upper surface of the decorative layer, preferably to an upper surface of the wear layer.

The lower side (rear side) of the core (layer(s)) may also constitute the lower side (rear side) of the panel as such. However, it is thinkable, and it may even be preferable, that the panel comprises a backing layer, either directly or indirectly, affixed to said lower said of the core. Typically, the backing layer acts as balancing layer in order to stabilize the shape, in particular the flatness, of the panel as such. Moreover, the backing layer typically contributes to the sound dampening properties of the panel as such. As the backing layer is typically a closed layer, the application of the backing layer to the lower side of the core will cover the core grooves at least partially, and preferably entirely. Here, the length of each core groove is preferably smaller than the length of said backing layer. The backing layer may be provided with cut-out portions, wherein at least a part of said cut-out portions overlap with at least one core groove. The at least one backing layer is preferably at least partially made of a flexible material, preferably an elastomer. The thickness of the backing layer typically varies from about 0.1 to 2.5 mm. Non-limiting examples of materials of which the backing layer can be at least partially composed are polyethylene, cork, polyurethane, polyvinylchloride, and ethylene-vinyl acetate. Optionally, the backing layer comprises one or more additives, such as fillers (like chalk), dyes, resins and/or one of more plasticizers. In a particular embodiment, the backing layer is at least partially made of a composite of ground (or shaved) cork particles bound by resin. Instead of cork other tree related products, such as wood, may be used. The thickness of a polyethylene backing layer is for example typically 2 mm or smaller. The backing layer may either be solid or foamed. A foamed backing layer may further improve the sound dampening properties. A solid backing layer may improve the desired balancing effect and stability of the panel.

In a preferred embodiment, at least one core layer comprises at least one main polymer, and at least one plasticizer composition which preferably comprises polyvinyl butyral (PVB), more preferably in a content of 35-65% % by weight of the plasticizer composition. This plasticizer composition has the benefit over classical plasticizers used in floor panels, that the composition is relatively safe to use and is less toxic. Thus a plasticizer composition is proposed which is well suitable to be incorporated in the decorative panel, in particular in the core (and/or another layer) of the decorative panel. At the same time, the panel is intrinsically elastically deformable due to the inclusion of the plasticizer composition in the material layer.

Furthermore, it has been found that in the claimed panel the components that are included in the plasticizer composition do not have the tendency to migrate through the main polymer matrix. A detrimental leaching out of plasticizer components from the matrix is thus avoided by incorporating a plasticizer composition as claimed. Moreover, the plasticizer composition used in the panel according to the invention is a polymer based plasticizer composition, preferably free of phthalates, and therefore differs over classical plasticizers. Hence, the polymer based plasticizer composition used in the panel according to the invention can also be considered as a flexibilizer composition, or more briefly as a flexibilizer. The presence of this plasticizer composition (or flexibilizer) provides the material layer(s) of the panel, and therefore the panel as such a desired flexibility (resiliency), which makes the panel less breakable, and therefore less vulnerable. Moreover, this also facilitates a proper installation of the panel onto e.g. a (slightly) uneven floor, and additionally improves the acoustic properties (both the sound transmission and the sound reflection) of the panel as such. The panels according to invention can even be provided sufficient flexibility to wind up the panel(s), which may facilitate storage and/or transport of the panel(s) prior to installation. It is thus imaginable that the panel is formed by a strip (or sheet) provided as a roll to be laid out by unrolling from said roll. The length of such a strip is typically between 1 and 30 meter. The panel may for instance be elongated, and have a width between 10 and 100 cm, and a length of 50 to 250 cm. The polymer blend compound used in at least one material layer of the core is primarily intended as a totally non-migrating plasticizer for flexible polymer based panels and/or for impact modification of other polymers, wherein both the elastic and the acoustical (sound-dampening) properties are improved. If PVB is used as sole plasticizer additive in for example a PVC based core, there is typically a poor compatibility between PVB and PVC leading to limited plasticizing effect and brittleness of the blend. Here, a less successful microstructure (with microvolumes of PVB embedded in a PVC based matrix) may also result unwanted drawbacks such as reduced tear strength, risk of partial deterioration over time and risk of uneven freeze-fracture. According to the present invention by including PVB in a solid state non-migrating plasticizer, by blending (mixing) PVB with one or more alloyed copolymers, the above mentioned drawbacks of using PVB as plasticizer, especially in PVC, are avoided. Further, PVB can be maximized and the properties of the final polymer matrix enhanced. Here an improved elongation at break, the change of flexural and tensile modulus, the improved strength and the maintained surface tension are typically considered as most important improved properties. This allows new design possibilities for designing the panel, in particular since this type of polymer based plasticizer composition is scalable, and the microstructure of the blend reproducible and homogeneous.

The panels according to the invention may also at least partially be made of magnesium oxide. More in particular, the panel according to the invention may comprise: at least one core layer provided with an upper side and a lower side, a decorative top structure (or top section) affixed, either directly or indirectly on said upper side of the core layer, wherein at least one core layer comprises: at least one composite layer comprising: at least one magnesium oxide (magnesia) and/or magnesium hydroxide based composition, in particular a magnesia cement. Particles, in particular cellulose and/or silicone based particles, may be dispersed in said magnesia cement. Optionally one or more reinforcement layers, such as glass fibre layers, may embedded in said composite layer. The core composition may also comprise magnesium chloride leading to a magnesium oxychloride (MOC) cement, and/or magnesium sulphate leading to magnesium oxysulphate (MOS) cement. It has been found that the application of a magnesium oxide and/or magnesium hydroxide based composition, and in particular a magnesia cement, including MOS and MOC, significantly improves the inflammability (incombustibility) of the decorative panel as such. Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. Moreover, magnesia cement is a relatively good insulating material, both thermally and electrically, which makes the panel in particularly suitable for flooring for radar stations and hospital operating rooms. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner. Moreover, an additional advantage of the decorative panel is that it is suitable both for indoor and outdoor use. As already addressed, the magnesia cement is based upon magnesium oxide and/or magnesium hydroxide. The magnesia cement as such may be free of magnesium oxide, dependent on the further reactants used to produce the magnesia cement. Here, it is, for example, well imaginable that magnesia as reactant is converted into magnesium hydroxide during the production process of the magnesia cement. Hence, the magnesia cement as such may comprise magnesium hydroxide. Typically, the magnesia cement comprises water, in particular hydrated water. Water is used as normally binder to create a strong and coherent cement matrix. The magnesia based composition, in particular the magnesia cement, may comprise magnesium chloride ($MgCl_2$). Typically, when magnesia ($MgO$) is mixed with magnesium chloride in an aqueous solution, a magnesia cement will be formed which comprises magnesium oxychloride (MOC). The bonding phases are $Mg(OH)_2$, $5Mg(OH)_2 \cdot MgCl_2 \cdot 8H_2O$ (5-form), $3Mg(OH)_2 \cdot MgCl_2 \cdot 8H_2O$ (3-form), and $Mg_2(OH)ClCO_3 \cdot 3H_2O$. The 5-form is the preferred phase, since this phase has superior mechanical properties. Related to other cement types, like Portland cement, MOC has superior properties. MOC does not need wet curing, has high fire resistance, low thermal conductivity, good resistance to abrasion. MOC cement can be used with different aggregates (additives) and fibres with good adherence resistance. It also can receive different kinds of surface treatments. MOC develops high compressive strength within 48 hours (e.g. 8,000-10,000 psi). Compressive strength gain occurs early during curing—48-hour strength will be at least 80% of ultimate strength. The compressive strength of MOC is preferably situated in between 40 and 100 N/mm2. The flexural tensile strength is preferably 10-17 N/mm2. The surface hardness of MOC is preferably 50-250 N/mm2. The E-Modulus is preferably 1-3 104 N/mm2. Flexural strength of MOC is relatively low but can be significantly improved by the addition of fibres, in particular cellulose based fibres. MOC is compatible with a wide variety of plastic fibres, mineral fibres (such as basalt fibres) and organic fibres such as bagasse, wood fibres, and hemp. MOC used in the panel according to the invention may be enriched by one or more of these fibre types. MOC is non-shrinking, abrasion and acceptably wear resistant, impact, indentation and scratch resistant. MOC is resistible to heat and freeze-thaw cycles and does not require air entrainment to improve durability. MOC has, moreover, excellent thermal conductivity, low electrical conductivity, and excellent bonding to a variety of substrates and additives, and has acceptable fire resistance properties. MOC is less preferred in case the panel is to be exposed to relatively extreme weather conditions (temperature and humidity), which affect both setting properties but also the magnesium oxychloride phase development. Over a period of time, atmospheric carbon dioxide will react with magnesium oxychloride to form a surface layer of $Mg_2(OH)ClCO_3 \cdot 3H_2O$. This layer serves to slow the leaching process. Eventually additional leaching results in the formation of hydromagnesite, $4MgO \cdot 3CO_3 \cdot 4H_2O$, which is insoluble and enables the cement to maintain structural integrity. The magnesium based composition, and in particular the magnesia cement, may be based upon magnesium sulphate, in particular heptahydrate sulphate mineral epsomite ($MgSO_4 \cdot 7H_2O$). This latter salt is also known as Epsom salt. In aqueous solution $MgO$ reacts with $MgSO_4$, which leads to magnesium oxysulfate cement (MOS), which has very good binding properties. In MOS, $5Mg(OH)_2 \cdot MgSO_4 \cdot 8H_2O$ is the most commonly found chemical phase. Although MOS is not as strong as MOC, MOS is better suited for fire resistive uses, since MOS start to decompose at temperatures more than two times higher than MOC giving longer fire protection. Moreover, their products of decomposition at elevated temperatures are less noxious (sulfur dioxide) than those of oxychloride (hydrochloric acid) and, in addition, less corrosive. Furthermore, weather conditions (humidity, temperature, and wind) during application are not as critical with MOS as with MOC. The mechanical strength of MOS cement depends mainly on the type and relative content of the crystal phases in the cement. It has been found that four basic magnesium salts that can contribute to the mechanical strength of MOS cement exist in the ternary system $MgO$-$MgSO_4$-$H_2O$ at different temperatures between of 30 and 120 degrees Celsius $5Mg(OH)$ 2·MgSO4·3H2O (513 phase), 3 Mg(OH)2·MgSO4·8H2O (318 phase), Mg(OH)2·2MgSO4·3H2O (123 phase), and Mg(OH)2·MgSO4·5H2O (115 phase). Normally, the 513 phase and 318 phase could only be obtained by curing cement under saturated steam condition when the molar ratio of MgO and MgSO4 was fixed at (approximately) 5:1. It has been found that the 318 phase is significantly contributing to the mechanical strength and is stable at room temperature, and is therefore preferred to be present in the MOS applied. This also applies to the 513 phase. The 513 phase typically has a (micro)structure comprising a needle-like structure. This can be verified by means of SEM analysis. The magnesium oxysulfate (5Mg(OH) 2·MgSO4·3H2O) needles may be formed substantially uniform, and will typically have a length of 10-15 μm and a diameter of 0.4-1.0 μm. When it is referred to a needle-like structure, also a flaky-structure and/or a whisker-structure can be meant. In practice, it does not seem feasible to obtain MOS comprising more than 50% 513 or 318 phase, but by adjusting the crystal phase composition can be applied to improve the mechanical strength of MOS. Preferably, the magnesia cement comprises at least 10%, preferably at least 20% and more preferably at least 30% of the 5Mg(OH) 2·MgSO4·3H2O (513-phase). This preferred embodiment will provide a magnesia cement having sufficient mechanical strength for use in the core layer of a floor panel. The crystal phase of MOS is adjustable by modifying the MOS by using an organic acid, preferably citric acid and/or by phosphoric acid and/or phosphates. During this modification new MOS phases can obtained, which can be expressed by 5Mg(OH) 2·MgSO4·5H2O (515 phase) and Mg(OH) 2·MgSO4·7H2O (517-phase). The 515 phase is obtainable by modification of the MOS by using citric acid. The 517 phase is obtainable by modification of the MOS by using phosphoric acid and/or phosphates (H3PO4, KH2PO4, K3PO4 and K2HPO4). These 515 phase and 517 phase can be determined by chemical element analysis, wherein SEM analysis proves that the microstructure both of the 515 phase and the 517 phase is a needle-like crystal, being insoluble in water. In particular, the compressive strength and water resistance of MOS can be improved by the additions of citric acid. Hence, it is preferred that MOS, if applied in the panel according to the invention, comprises 5Mg(OH) 2·MgSO4·5H2O (515 phase) and/or Mg(OH) 2·MgSO4·7H2O (517-phase). As addressed above, adding phosphoric acid and phosphates can extend the setting time and improve the compressive strength and water resistance of MOS cement by changing the hydration process of MgO and the phase composition. Here, phosphoric acid or phosphates ionize in solution to form H2PO4-, HPO42-, and/or PO43-, wherein these anions adsorb onto [Mg(OH)(H2O) x]+ to inhibit the formation of Mg(OH)2 and further promote the generation of a new magnesium subsulfate phase, leading to the compact structure, high mechanical strength and good water resistance of MOS cement. The improvement produced by adding phosphoric acid or phosphates to MOS cement follows the order of H3PO4=KH2PO+ >>K2HPO4>>K3PO4. MOS has better volumetric stability, less shrinkage, better binding properties and lower corrosivity under a significantly wider range of weather conditions than MOC, and could therefore be preferred over MOS. The density of MOS typically varies from 350 to 650 kg/m3. The flexural tensile strength is preferably 1-7 N/mm2.

The magnesium cement composition preferably comprises one or more silicone based additives. Various silicone based additives can be used, including, but not limited to, silicone oils, neutral cure silicones, silanols, silanol fluids, silicone (micro)spheres, and mixtures and derivatives thereof. Silicone oils include liquid polymerized siloxanes with organic side chains, including, but not limited to, polymethylsiloxane and derivatives thereof. Neutral cure silicones include silicones that release alcohol or other volatile organic compounds (VOCs) as they cure. Other silicone based additives and/or siloxanes (e.g., siloxane polymers) can also be used, including, but not limited to, hydroxyl (or hydroxy) terminated siloxanes and/or siloxanes terminated with other reactive groups, acrylic siloxanes, urethane siloxanes, epoxy siloxanes, and mixtures and derivatives thereof. As detailed below, one or more cross-linkers (e.g., silicone based crosslinkers) can also be used. The viscosity of the one or more silicone based additives (e.g., silicone oil, neutral cure silicone, silanol fluid, siloxane polymers, etc.) may be about 100 cSt (at 25° C.), which is called low-viscous. In alternative embodiments, the viscosity of the one or more silicone based additives (e.g., silicone oil, neutral cure silicone, silanol fluid, siloxane polymers, etc.) is between about 20 cSt (25° C.) and about 2000 cSt (25° C.). In other embodiments, the viscosity of the one or more silicone based additives (e.g., silicone oil, neutral cure silicone, silanol fluid, siloxane polymers, etc.) is between about 100 cSt (25° C.) and about 1250 cSt (25° C.). In other embodiments, the viscosity of the one or more silicone based additives (e.g., silicone oil, neutral cure silicone, silanol fluid, siloxane polymers, etc.) is between about 250 cSt (25° C.) and 1000 cSt (25° C.). In yet other embodiments, the viscosity of the one or more silicone based additives (e.g., silicone oil, neutral cure silicone, silanol fluid, siloxane polymers, etc.) is between about 400 cSt (25° C.) and 800 cSt (25° C.). And in particular embodiments, the viscosity of the one or more silicone based additives (e.g., silicone oil, neutral cure silicone, silanol fluid, siloxane polymers, etc.) is between about 800 cSt (25° C.) and about 1250 cSt (25° C.). One or more silicone based additives having higher and/or lower viscosities can also be used. For example, in further embodiments, the viscosity of the one or more silicone based additives (e.g., silicone oil, neutral cure silicone, silanol fluid, siloxane polymers, etc.) is between about 20 cSt (25° C.) and about 200,000 (25° C.) cSt, between about 1,000 cSt (25° C.) and about 100,000 cSt (25° C.), or between about 80,000 cSt (25° C.) and about 150,000 cSt (25° C.). In other embodiments, the viscosity of the one or more silicone based additives (e.g., silicone oil, neutral cure silicone, silanol fluid, siloxane polymers, etc.) is between about 1,000 cSt (25° C.) and about 20,000 cSt (25° C.), between about 1,000 cSt (25° C.) and about 10,000 cSt (25° C.), between about 1,000 cSt (25° C.) and about 2,000 cSt (25° C.), or between about 10,000 cSt (25° C.) and about 20,000 cSt (25° C.). In yet other embodiments, the viscosity of the one or more silicone based additives (e.g., silicone oil, neutral cure silicone, silanol fluid, siloxane polymers, etc.) is between about 1,000 cSt (25° C.) and about 80,000 cSt (25° C.), between about 50,000 cSt (25° C.) and about 100,000 cSt (25° C.), or between about 80,000 cSt (25° C.) and about 200,000 cSt (25° C.). And in still further embodiments, the viscosity of the one or more silicone based additives (e.g., silicone oil, neutral cure silicone, silanol fluid, siloxane polymers, etc.) is between about 20 cSt (25° C.) and about 100 cSt (25° C.). Other viscosities can also be used as desired. In a preferred embodiment, the magnesium cement composition, in particular the magnesium oxychloride cement composition, comprises a single type of silicone based additive. In other embodiments, a mixture of two or more types of silicone based additives are used. For example, in some embodiments, the magnesium oxychloride cement composition can include a mixture of one or more silicone oils and neutral cure silicones. In particular embodiments, the ratio of silicone oil to neutral cure silicone can be between about 1:5 and about 5:1, by weight. In other such embodiments, the ratio of silicone oil to neutral cure silicone can be between about 1:4 and about 4:1, by weight. In other such embodiments, the ratio of silicone oil to neutral cure silicone can be between about 1:3 and about 3:1, by weight. In yet other such embodiments, the ratio of silicone oil to neutral cure silicone can be between about 1:2 and about 2:1, by weight. In further such embodiments, the ratio of silicone oil to neutral cure silicone can be about 1:1, by weight. It is imaginable that one or more crosslinkers are used in the magnesia cement. In some embodiments, the crosslinkers are silicone based crosslinkers. Exemplary crosslinkers include, but are not limited to, methyltrimethoxysilane, methyltriethoxysilane, methyltris(methylethylketoximino) silane and mixtures and derivatives thereof. Other crosslinkers (including other silicone based crosslinkers) can also be used. In some embodiments, the magnesium oxychloride cement composition comprises one or more silicone based additives (e.g., one or more silanols and/or silanol fluids) and one or more crosslinkers. The ratio of one or more silicone based additives (e.g., silanols and/or silanol fluids) to crosslinker can be between about 1:20 and about 20:1, by weight, between about 1:10 and about 10:1 by weight, or between about 1:1 and about 10:1, by weight.

The magnesium (oxychloride) cement compositions comprising one or more silicone based additives may exhibit reduced sensitivity to water as compared to traditional magnesium (oxychloride) cement compositions. Further, in some embodiments, the magnesium (oxychloride) cement compositions comprising one or more silicone based additives may exhibit little or no sensitivity to water. The magnesium (oxychloride) cement compositions comprising one or more silicone based additives can further exhibit hydrophobic and water resistant properties.

Also, the magnesium (oxychloride) cement compositions comprising one or more silicone based additives can exhibit improved curing characteristics. For example, magnesium (oxychloride) cement compositions cure to form various reaction products, including 3Mg(OH)2·MgCl2·8H2O (phase 3) and 5Mg(OH)2·MgCl2·8H2O (phase 5) crystalline structures. In some situations, higher percentages of the 5Mg(OH)2·MgCl2·8H2O (phase 5) crystalline structure is preferred. In such situations, the addition of one or more silicone based additives to the magnesium oxychloride cement compositions can stabilize the curing process which can increase the percentage yield of 5Mg(OH)2·MgCl2·8H2O (phase 5) crystalline structures. For example, in some embodiments, the magnesium oxychloride compositions comprising one or more silicone based additives can cure to form greater than 80% 5Mg(OH)2·MgCl2·8H2O (phase 5) crystalline structures. In other embodiments, the magnesium oxychloride compositions comprising one or more silicone based additives can cure to form greater than 85% 5Mg(OH)2·MgCl2·8H2O (phase 5) crystalline structures. In yet other embodiments, the magnesium oxychloride compositions comprising one or more silicone based additives can cure to form greater than 90% 5Mg(OH)2·MgCl2·8H2O (phase 5) crystalline structures. In yet other embodiments, the magnesium oxychloride compositions comprising one or more silicone based additives can cure to form greater than 95% 5Mg(OH)2·MgCl2·8H2O (phase 5) crystalline structures. In yet other embodiments, the magnesium oxychloride compositions comprising one or more silicone based additives can cure to form greater than 98% 5Mg(OH)2·MgCl2·8H2O (phase 5) crystalline structures. In yet other embodiments, the magnesium oxychloride compositions comprising one or more silicone based additives can cure to form about 100% 5Mg(OH)2·MgCl2·8H2O (phase 5) crystalline structures.

Furthermore, the magnesium (oxychloride) cement compositions comprising one or more silicone based additives can also exhibit increased strength and bonding characteristics. If desired, the magnesium (oxychloride) cement compositions comprising one or more silicone based additives can also be used to manufacture magnesium (oxychloride) cement or concrete structures that are relatively thin. For example, the magnesium (oxychloride) cement compositions comprising one or more silicone based additives can be used to manufacture cement or concrete structures or layers having thicknesses of less than 8 mm, preferably less than 6 mm. For realizing the coupling between the coupling part, temporary deformation of the coupling part(s) may be desired and/or even required, as a result of which it is beneficial to mix magnesium oxide and/or magnesium hydroxide and/or magnesium chloride and/or magnesium sulphate with one or more silicone based additives, since this leads to an increased a degree of flexibility and/or elasticity. For example, in some embodiments, cement and concrete structures formed using the magnesium oxychloride cement compositions can bend or flex without cracking or breaking. The magnesium (oxychloride) cement compositions comprising one or more silicone based additives can further comprise one or more additional additives. The additional additives can be used to enhance particular characteristics of the composition. For example, in some embodiments, the additional additives can be used to make the structures formed using the disclosed magnesium oxychloride cement compositions look like stone (e.g., granite, marble, sandstone, etc.). In particular embodiments, the additional additives can include one or more pigments or colorants. In other embodiments, the additional additives can include fibres, including, but not limited to, paper fibres, wood fibres, polymeric fibres, organic fibres, and fiberglass. The magnesium oxychloride cement compositions can also form structures that are UV stable, such that the colour and/or appearance is not subject to substantial fading from UV light over time. Other additives can also be included in the composition, including, but not limited to plasticizers (e.g., polycarboxylic acid plasticizers, polycarboxylate ether-based plasticizers, etc.), surfactants, water, and mixtures and combinations thereof. As indicated above, the magnesium oxychloride cement composition, if applied, can comprise magnesium oxide (MgO), aqueous magnesium chloride (MgCl¬2 (aq)), and one or more silicone based additives. Instead of aqueous magnesium chloride (MgCl2) magnesium chloride (MgCl2) powder can also be used. For example, magnesium chloride (MgCl2) powder can be used in combination with an amount of water that would be equivalent or otherwise analogous to the addition of aqueous magnesium chloride (MgCl2 (aq)). In certain embodiments, the ratio of magnesium oxide (MgO) to aqueous magnesium chloride (MgCl2 (aq)), if applied, in the magnesium oxychloride cement composition can vary. In some of such embodiments, the ratio of magnesium oxide (MgO) to aqueous magnesium chloride (MgCl2 (aq)) is between about 0.3:1 and about 1.2:1, by weight. In other embodiments, the ratio of magnesium oxide (MgO) to aqueous magnesium chloride (MgCl2 (aq)) is between about 0.4:1 and about 1.2:1, by weight. And in yet other embodiments, the ratio of magnesium oxide (MgO) to aqueous magnesium chloride (MgCl2 (aq)) is between about 0.5:1 and about 1.2:1, by weight. The aqueous magnesium chloride (MgCl2 (aq)) can be described as (or otherwise derived from) a magnesium chloride brine solution. The aqueous magnesium chloride (MgCl2 (aq)) (or magnesium chloride brine) can also include relatively small amounts of other compounds or substances, including but not limited to, magnesium sulphate, magnesium phosphate, hydrochloric acid, phosphoric acid, etcetera. In a preferred embodiment the amount of the one or more (liquid) silicone based additives within the magnesium oxychloride cement composition can be defined as the ratio of silicone based additives to magnesium oxide (MgO). For example, in some embodiments, the weight ratio of silicone based additives to magnesium oxide (MgO), is between 0.06 and 0.6.

Preferably, It is also imaginable, and even favourable, to incorporate in the core layer at least one oil, such as linseed oil or silicon oil. This renders the magnesium based core layer and/or thermoplastic based core layer more flexibility and reduced risk of breakage. Instead of or in addition to oil it is also imaginable to incorporate in the core layer one or more water-soluble polymers or polycondensed (synthetic) resins, such as polycarboxylic acid. This leads to the advantage that during drying/curing/setting the panel will not shrink which prevents the formation of cracks, and moreover provides the core layer, after drying/curing/setting, a more hydrophobic character, which prevents penetration of water (moisture) during subsequent storage and use.

It is imaginable that the core layer comprises polycaprolactone (PCL). This biodegradable polymer is especially preferred as this has been found to be made to melt by the exothermic reaction of the reaction mixture. It has a melting point of ca. 60° C. The PCL may be low density or high density. The latter is especially preferred as it produces a stronger core layer. Instead of, or in addition to, other polymers may be used, preferably a polymer chosen from the group consisting of: other poly(lactic-co-glycolic acid) (PLGA), poly(lactic acid) (PLA), poly(glycolic acid) (PGA), the family of polyhydroxyalkanoates (PHA), polyethylene glycol (PEG), polypropylene glycol (PPG), polyesteramide (PEA), poly(lactic acid-co-caprolactone), poly (lactide-co-trimethylene carbonate), poly(sebacic acid-co-ricinoleic acid) and a combination thereof.

Alternatively, the panel, in particular the core layer, may at least partly be made of PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. Recycled PUR may be made based on recyclable polymers, such as based on recyclable PET. PET can be recycled chemically by using glycolysis or depolymerisation of PET into monomers or oligomers, and subsequently into polyurethane polyols in the end. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based. The core (layer) may be solid or foamed, or both in case the core is composed of a plurality of parts/layers.

It may be advantageous in case the core layer comprises porous granules, in particular porous ceramic granules. Preferably the granules have a plurality of micropores of an average diameter of from 1 micron to 10 micron, preferably from 4 to 5 micron. That is, the individual granules preferably have micropores. Preferably, the micropores are interconnecting. They are preferably not confined to the surface of the granules but are found substantially throughout the cross-section of the granules. Preferably, the size of the granules is from 200 micron to 900 micron, preferably 250 micron to 850 micron, especially 250 to 500 micron or 500 to 850 micron. Preferably, at least two different sizes of granules, most preferably two, are used. Preferably, small and/or large granules are used. The small granules may have a size range of 250 to 500 micron. Preferably the large granules have a diameter of 500 micron to 850 micron. The granules may each be substantially of the same size or of two or more predetermined sizes. Alternatively, two or more distinct size ranges may be used with a variety of different sized particles within each range. Preferably two different sizes or ranges of sizes are used. Preferably, the granules each comprise a plurality of microparticles, substantially each microparticle being partially fused to one or more adjacent microparticles to define a lattice defining the micropores. Each microparticle preferably has an average size of 1 micron to 10 micron, with an average of 4 to 5 micron. Preferably, the average size of the micropores is from 2 to 8 micron, most preferably 4 to 6 micron. The micropores may be irregular in shape. Accordingly, the size of the micropores, and indeed the midi-pores referred to below, are determined by adding the widest diameter of the pore to the narrowest diameter of the pore and dividing by 2. Preferably, the ceramic material is evenly distributed throughout a cross-section of the core layer, that is substantially without clumps of ceramic material forming. Preferably, the microparticles have an average size of at least 2 micron or 4 micron and/or less than 10 micron or less than 6 micron, most preferably 5 to 6 micron. This particle size range has been found to allow the controlled formation of the micropores.

The granules may also comprise a plurality of substantially spherical midi-pores having an average diameter of 10 to 100 micron. They substantially increase the total porosity of the ceramic material without compromising the mechanical strength of the materials. The midi-pores are preferably interconnected via a plurality of micropores. That is, the midi-pores may be in fluid connection with each other via micropores. The average porosity of the ceramic material itself is preferably at least 50%, more preferably greater than 60%, most preferably 70 to 75% average porosity. The ceramic material used to produce the granules may be any (non-toxic) ceramic known in the art, such as calcium phosphate and glass ceramics. The ceramic may be a silicate, though is preferably a calcium phosphate, especially [alpha]- or [beta]-tricalcium phosphate or hydroxyapatite, or mixtures thereof. Most preferably, the mixture is hydroxyapatite and [beta]-tricalcium phosphate, especially more than 50% w/w [beta]-tricalcium, most preferably 85% [beta]-tricalcium phosphate and 15% hydroxyapatite. Most preferably the material is 100% hydroxyapatite. Preferably the cement composition or dry premix comprises 15 to 30% by weight of granules of the total dry weight of the composition or premix.

The porous particles could lead to a lower average density of the core layer and hence to a reduction of weight which is favourable from an economic and handling point of view. Moreover, the presence of porous particles in the core layer typically leads to, at least some extent, an increased porosity of a porous top surface and bottom surface of the core layer, which is beneficial for attaching an additional layer to the top surface and/or bottom surface of the core layer, such as, for example, a primer layer, an (initially liquid) adhesive layer, or another decorative or functional layer. Often, these layers are initially applied in a liquid state, wherein the pores allow the liquid substance to be sucked up (to permeate) into the pores, which increases the contact surface area between the layers and hence improves the bonding strength between said layers.

Although most decorative panels according to the invention will have a square or rectangular shape, it is also conceivable that the panel according to the invention has another shape (as seen from a top view), such as a hexagonal shape, an octagonal shape, a diamond shape, or a parallelogrammatic shape. Preferably, the panel thickness is situated in the range of 3.0 mm to 20.0 mm, preferably in the range of 4.0 mm to 12.0 mm. The panel according to the invention may be rigid, semi-rigid, or flexible. Typically, the panels will have at least a fraction of resiliency in order to allow coupling of the coupling part and to realize (and maintain) the desired tension force.

The invention also relates to a decorative covering for a floor, ceiling or wall, which is constituted by a multitude of interconnected decorative panels according to the invention.

Further embodiments of the invention are described in the non-limitative set of clauses presented below.

Clauses

1. Decorative panel, in particular a floor panel, wall panel, or ceiling panel, comprising, at least at a first pair of opposite edges, a first coupling part and a second coupling part allowing that several of such panels can be coupled to each other, whereby these coupling parts, in coupled condition of two of such panels, provide a locking in a first direction (R1) perpendicular to the plane of the panels, as well as in a second direction (R2) perpendicular to the respective edges and parallel to the plane of the panels, wherein said first coupling part comprises a sideward tongue, wherein said sideward tongue comprises a front region and a back region, wherein a bottom surface and/or a side surface of said front region being rounded at least partly, wherein a top surface of the front region is at least partially inclined downwardly in a direction away from the back region, and wherein a bottom surface and/or side surface of the back region of said sideward tongue defines a first contact portion, and wherein the sideward tongue comprises a passive bottom surface situated adjacent to the first contact portion, wherein said passive bottom surface is defined by a cut-out portion at a lower side of the sideward tongue, wherein said second coupling part comprises a recess for accommodating at least a part of the sideward tongue of a further panel, said recess being defined by an upper lip and a lower lip, wherein the lower lip extends beyond the upper lip, and wherein the lower lip being provided with a upwardly protruding shoulder defining a second contact portion configured to actively co-act with said first contact portion of another panel, in coupled condition of said panels, such that that the panels are forced with a tension force (T1) at least laterally towards each other, wherein a top surface of said lower lip is smoothly curved at least partially and is configured as sliding surface for the at least partially rounded bottom surface and/or side surface of the front region of the sideward tongue of another panel during coupling, and wherein said at least partially curved top surface of the lower lip and said passive bottom surface of the sideward tongue are mutually situated such that, in coupled condition of two panels, an intermediate space is present adjacent to actively co-acting first and second contact portions, and wherein a lower surface of the upper lip is at least partially inclined and configured to abut at least a part of the top surface of the front region of the sideward tongue of another panel.

2. Panel according to clause 1, wherein the passive bottom surface of the sideward tongue is substantially flat.

3. Panel according to clause 1 or 2, wherein the passive bottom surface is at least partially inclined downwardly in a direction towards the front region.

4. Panel according to clause 3, wherein the inclined top surface of the sideward tongue and the inclined passive bottom surface converge in a direction away from the back region of the sideward tongue.

5. Panel according to one of the foregoing clauses, wherein the top surface of the lower lip defines a deepest point of the recess, and wherein, in coupled condition of two panels, said deepest point is positioned at a distance from the passive bottom surface.

6. Panel according to one of the foregoing clauses, wherein the top surface of the lower lip defines a deepest point of the recess, wherein the shoulder of the lower lip defines a highest point of the lower lip, wherein said deepest point and highest point define a lower lip depth (LLD), and wherein the first and second contact portions are entirely located above half the lower lip depth.

7. Panel according to one of the foregoing clauses, wherein the top surface of the lower lip defines a deepest point of the recess, wherein the shoulder of the lower lip defines a highest point of the lower lip, wherein said deepest point and highest point define a lower lip depth (LLD), and wherein the smallest thickness (STD) of the sideward tongue, measured between the at least partially inclined upper surface and the passive bottom surface of the sideward tongue exceeds the lower lip depth.

8. Panel according to one of the foregoing clauses, wherein the first contact portion is inclined upwardly in a direction away from the front region of the sideward tongue, wherein the inclined first contact portion and the plane of the panel preferably encloses an angle of at least 45 degrees, and wherein the second contact portion is inclined upwardly in a direction away from the upper lip, wherein the inclined second contact portion and the plane of the panel preferably encloses an angle of at least 45 degrees.

9. Panel according to one of the foregoing clauses, wherein the first contact portion and the second contact portion extend in a substantially parallel direction.

10. Panel according to one of the foregoing clauses, wherein the bottom surface and/or side surface of the front region of the sideward tongue is configured to co-act with the lower lip in coupled condition of two panels, and together define a bottom front contact surface.

11. Panel according to clause 10, wherein the entire bottom front contact surface is located underneath the level of the first and second contact portions.

12. Panel according to clause 10 or 11, wherein the bottom front contact surface on one side and the contact surface defined by the first and second contact portions on the other side mutually enclose an angle of between 70 and 110 degrees, preferably between 80 and 100 degrees.

13. Panel according to one of the foregoing clauses, wherein a seam formed by two panels in coupled condition define a vertical plane (VP), wherein said vertical plane subdivides the lower lip into an inner lower lip part and an outer lower lip lower part.

14. Panel according to one of clauses 10-12 and clause 13, wherein at least a part of the bottom front contact surface, preferably the entire bottom front contact surface, and the first and second contact portions are situated at the same side of the vertical plane.

15. Panel according to clause 13 or 14, wherein the upper surface of the front region of the sideward tongue intersects the vertical plane (VP).

16. Panel according to one of clauses 13-15, wherein the entire top surface of the lower lip extending in between said vertical plane (VP) and the second contact portion is a smooth curved surface.

17. Panel according to one of the foregoing clauses, wherein the upper surface of the lower lip is provided with a staggered cut-out portion, which is at least partially located underneath the upper lip, and which is configured to accommodate a terminal portion of the sideward tongue of another panel.

18. Panel according to clause 17, wherein the upper lip and the staggered cut-out portion of the lower lip are configurated to clamp the terminal portion of the sideward tongue.

19. Panel according to one of clauses 17-18, wherein the staggered cut-out portion is entirely positioned underneath the upper lip.

20. Panel according to one of the foregoing clauses, wherein the panel defines a top surface and a bottom surface defining the thickness (PT) of the panel, and wherein the thickness of the shoulder (ST), as measured from the bottom surface of the panel to the highest point of the shoulder, exceeds 30%, preferably 50%, of the panel thickness (PT).

21. Panel according to one of the foregoing clauses, wherein, in coupled condition of the panels, a top surface of the shoulder is positioned at a distance from a facing lower surface of the first coupling part.

22. Panel according to one of the foregoing clauses, wherein a top surface of the shoulder is substantially parallel to the plane of the panel.

23. Panel according to one of the foregoing clauses, wherein a seam formed by or in between two panels in coupled condition defines a vertical plane (VP), wherein said vertical plane subdivides the lower lip into an inner lower lip part and an outer lower lip lower part, and wherein, in coupled condition, the entire bottom surface and the entire side surface of the inner lower lip part are positioned at distance from the second coupling part.

24. Panel according to one of the foregoing clauses, wherein the lower lip is entirely located underneath the upper lip.

25. Panel according to one of the foregoing clauses, wherein the upper surface of the front region of the sideward tongue and a side surface of the front region of the sideward tongue are connected by means of a transitional convex surface.

26. Panel according to one of the foregoing clauses, wherein the lower surface of the upper lip and a side surface of the upper lip are connected by means of a transitional convex surface.

27. Panel according to one of the foregoing clauses, wherein the first coupling part and the second coupling part are also provided at least at a second pair of opposite edges.

28. Panel according to one of the foregoing clauses, wherein the panel comprises, at least at a further, in particular second, pair of opposite edges, a third coupling part and a fourth coupling part allowing that several of such panels can be coupled to each other by means of a lowering or vertical motion, whereby these coupling parts, in coupled condition of two of such panels, provide a locking in a first direction (R1) perpendicular to the plane of the panels, as well as in a second direction (R2) perpendicular to the respective edges and parallel to the plane of the panels, wherein the third coupling part comprises an upward tongue, at least one upward flank situated at a distance from the upward tongue and an upward groove formed in between the upward tongue and the upward flank, wherein the upward groove is adapted to receive at least a part of a downward tongue of the fourth coupling part of another panel, wherein the side of the upward tongue facing the upward flank is the inside of the upward tongue and the side of the upward tongue facing away from the upward flank is the outside of the upward tongue, wherein the fourth coupling part comprises a downward tongue, at least one downward flank situated at a distance from the downward tongue, and a downward groove formed in between the downward tongue and the downward flank, wherein the downward groove is adapted to receive at least a part of the upward tongue of the third coupling part of another panel, wherein the side of the downward tongue facing the downward flank is the inside of the downward tongue and the side of the downward tongue facing away from the downward flank is the outside of the downward tongue.

29. Panel according to clause 28, wherein the inside of the upward tongue and the inside is configured to co-act with the inside of the downward tongue of another panel, in coupled condition of said panels, such that that the panels are forced with a tension force (T2) at least laterally towards each other.

30. Panel according to clause 28 or 29, wherein at least a part of the inside of the upward tongue is inclined towards the upward flank, and wherein at least of part of the inside of the downward tongue is inclined towards the downward flank, allowing two panels to be locked in the first direction (R1).

31. Panel according to one of clauses 28-30, wherein the outside of the upward tongue is provided with a first locking element, and wherein the downward flank is provided with a second locking element configured for co-action with the first locking element of another panel, allowing two panels to be locked in the first direction (R1).

32. Panel according to clause 31, wherein the first locking element comprises an outward bulge and wherein the second locking element comprising a recess, wherein the outside of the outward bulge comprises an upper portion and an adjoining lower portion, wherein the lower portion comprises an inclined locking surface and the upper portion comprises a, preferably curved, guiding surface, wherein said recess comprises an upper portion and an adjoining lower portion, wherein the lower portion comprises an inclined locking surface, wherein, in coupled condition of adjacent panels, the inclined locking surface of the lower portion of the outward bulge and the inclined locking surface of lower portion of the recess are in contact to realise said locking effect between the panels and/or wherein, in coupled condition of adjacent panels, the upper portions of the first locking element and the second locking element are preferably spaced apart at least partially.

33. Panel according to clause 32, wherein the length of the inclined locking surface of the lower portion of the outward bulge is larger, preferably at least 1.5 times larger, than the inclined locking surface of the lower portion of the recess.

34. Panel according to clause 32 or 33, wherein the upper portion extends over a larger vertical section compared to the lower portion, wherein, preferably, the height of the upper portion is at least three times the height of the lower portion.

35. Panel according to one of clauses 28-34, wherein the upward flank and the outside of the downward tongue define substantially vertical upper contact surfaces of the panel, and wherein adjoining the upper contact surfaces both the downward tongue and the upward flank comprise an inclined contact surface, wherein the inclined contact surface of the downward tongue of said panel is configured to engage the inclined contact surface of the upward flank of an adjacent panel, in coupled condition of said panels, wherein each substantially vertical upper contact surface and each adjoining inclining surface mutually enclose an angle (a) between 100 and 175 degrees.

36. Panel according to one of clauses 28-35, wherein the outside of the downward tongue is provided with a third locking element, and wherein the upward flank is provided with a fourth locking element configured for co-action with the third locking element of another panel, allowing two panels to be locked in the first direction (R1).

37. Panel according to clause 35 and 36, wherein the third locking element is at least partially defined by the upper contact surface of the downward tongue, and wherein the fourth locking element is at least partially defined by the upper contact surface of the upward flank.

38. Panel according to any of the foregoing clauses, wherein at least a part of each of the coupling parts makes integral part of a core layer of the panel.

39. Panel according to any of the foregoing clauses, wherein the panel comprises at least one core layer, and at least one decorative top section, directly or indirectly affixed to said core layer, wherein the top section defines a top surface of the panel.

40. Panel according to clause 39, wherein the top section comprises a printed decorative layer, and at least one wear layer covering said printed decorative layer.

41. Panel according to clause 39 or 40, wherein at least one core layer comprises a moisture sensitive material, such as wood.

42. Panel according to one of clauses 39-41, wherein at least one core layer is at least partially composed of medium-density fibreboard (MDF) or high-density fibreboard (HDF).

43. Panel according to one of the foregoing clauses, wherein the panel is of a rectangular or hexagonal shape.

44. Panel according to one of the foregoing clauses, wherein the panel has a vertical thickness in the range of 3.0 mm to 20.0 mm, preferably in the range of 4.0 mm to 12.0 mm.

45. Panel according to one of the foregoing clauses, wherein the substantially entire top surface of the lower lip is smoothly curved according to a substantially constant radius.

46. Panel according to one of the foregoing clauses, wherein the top surface of the lower lip comprises a curved back top surface and a curved front top surface, wherein the back top surface and the front top surface are staggered with respect to each other, and wherein preferably the front top surface is deepened with respect to the back top surface.

47. Panel according to one of the foregoing clauses, wherein the side surface of the front region of the sideward tongue and a facing part of the top surface of the lower lip are substantially complementary shaped, and preferably substantially complementary curved.

48. Panel according to one of the foregoing clauses, wherein the maximum distance a between the side surface of the front region of the sideward tongue and a facing part of the top surface of the lower lip is smaller than the maximum distance b between the passive bottom surface of the sideward tongue and a facing part of the top surface of the lower lip.

49. Decorative covering for a floor, ceiling or wall, which is constituted by a multitude of interconnected decorative panels according to one of the foregoing clauses.

BRIEF DESCRIPTION OF THE DRAWINGS

The invention will be elucidated on the basis of non-limitative exemplary embodiments shown in the following figures, wherein.

DESCRIPTION OF THE INVENTION

Figure 1:
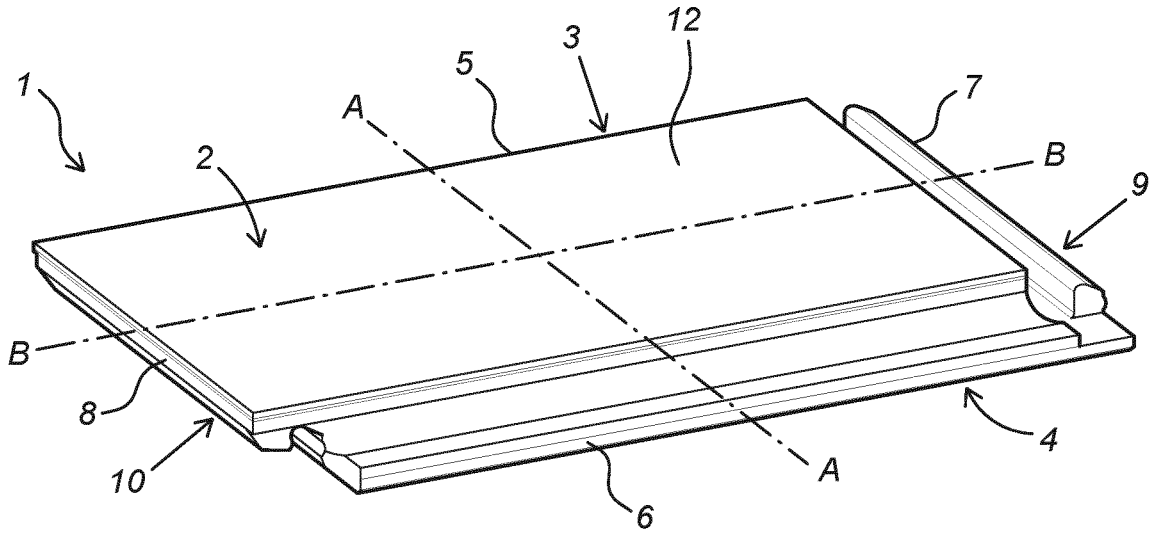
FIG. 1 shows a rectangular floor panel according to the present invention.

FIG. 1 shows a decorative panel 1 which upper side 2 is provided with a decorative top layer 12. The panel is of a rectangular shape having a length extending longitudinally along line B-B, and a width extending transversally along line A-A. The plane of the panel is hence determined by the combination of lines A-A and B-B. At opposite side edges 3 and 4, a first coupling part in the form of profile 5, resp. a second coupling part in the form of profile 6 is provided. At opposite side edges 9 and 10, a third coupling part in the form of profile 7 resp. a fourth coupling part in the form of profile 8 is provided.

Figure 2:
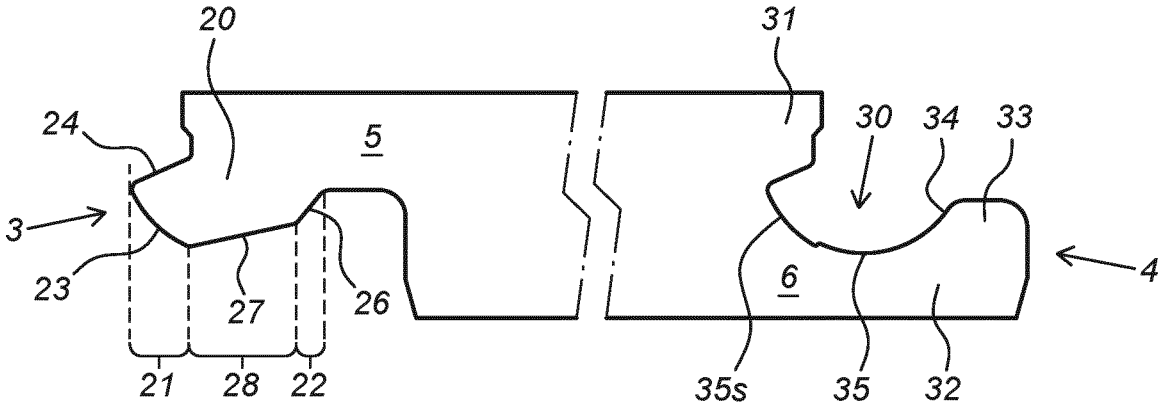
FIG. 2 shows a transversal cross-section along line A-A in FIG. 1, of respective side edges.

FIG. 2 shows in transversal cross-section the first coupling part 5 at side edge 3. The first coupling part 5 comprises a sideward tongue 20 which comprises a front region 21 and a back region 22, wherein a bottom surface 23 and/or a side surface 23 of said front region 21 is rounded at least partly, wherein a top surface 24 of the front region 21 is at least partially inclined downwardly in a direction away from the back region 22, and wherein a bottom surface 26 and/or side surface 26 of the back region 22 of said sideward tongue 20 defines a first contact portion 26, and wherein the sideward tongue 20 comprises a passive bottom surface 27 situated adjacent to the first contact portion 26, wherein said passive bottom surface 27 is defined by a cut-out portion at a lower side of the sideward tongue 20. The passive bottom surface 27 herein extends over an intermediate region 28 between the back region 22 and the front region 21, and is substantially flat. The passive bottom surface 27 is inclined downwardly in a direction towards the front region 21, such that the inclined top surface 24 of the sideward tongue and the inclined passive bottom surface 27 converge in a direction away from the back region of the sideward tongue. Furthermore, the second coupling part 6 comprises a recess 30 for accommodating at least a part of the sideward tongue 20 of a further panel, said recess 30 being defined by an upper lip 31 and a lower lip 32, wherein the lower lip 32 extends beyond the upper lip 31, and wherein the lower lip 32 is provided with a upwardly protruding shoulder 33 defining a second contact portion 34 configured to actively co-act with a first contact portion 26 of another panel, in coupled condition of such panels as will be discussed with reference to FIG. 4. A top surface 35 of the lower lip 32 is smoothly curved at least partially and is configured as sliding surface for the at least partially rounded bottom surface 23 and/or side surface 23 of the front region 21 of the sideward tongue 20 of another panel during coupling of a first and second coupling part. The upper surface 35 of the lower lip is provided with a staggered cut-out portion 35*s*, which is at least partially located underneath the upper lip 31, and which is configured to accommodate a terminal portion of the sideward tongue 20 of another panel.

Figure 3:
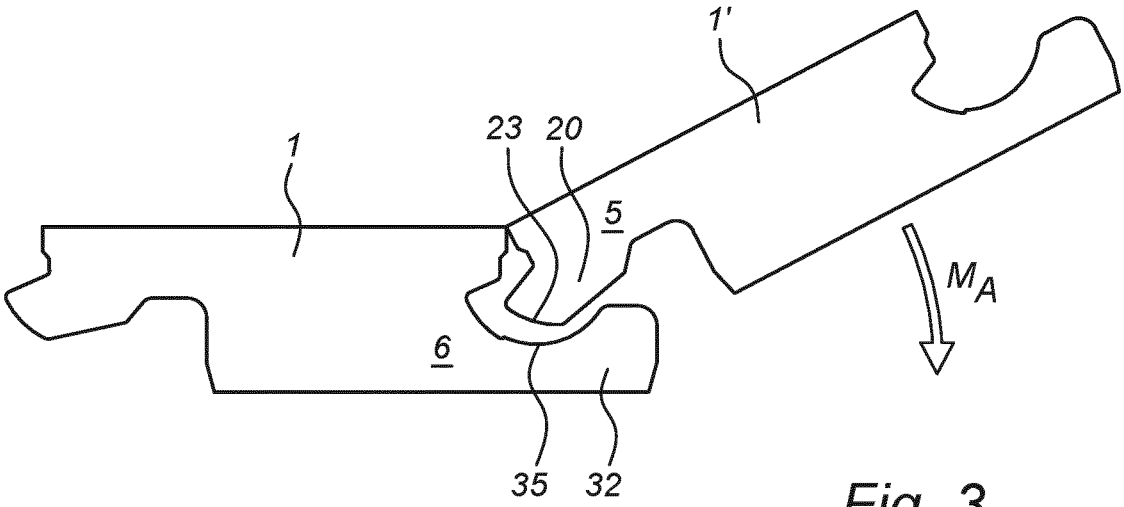
FIG. 3 shows a method of coupling of the side edges shown in FIG. 2.

FIG. 3 shows a method of coupling of two panels 1 and 1', each being provided with first and second coupling parts 5 and 6 as shown in FIG. 2. The two panels are coupled to each other by an angling movement over arrow MA. As evident from FIG. 3, the curvature of top surface 35 of the lower lip 32 functions as sliding surface for the at least partially rounded bottom surface 23 and/or side surface 23 of the tongue 20.

Figure 4:
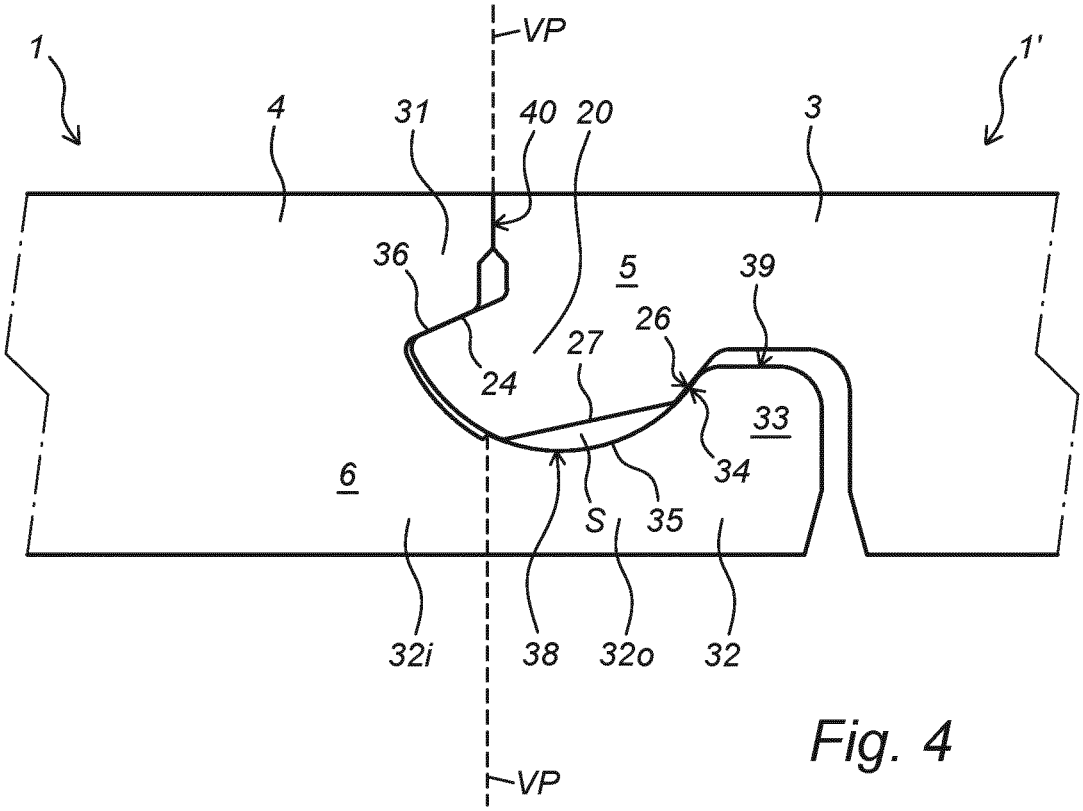
FIG. 4 shows in a transversal cross-section, the side edges of FIG. 2 in coupled condition.

FIG. 4 shows the coupling parts 5 and 6 of the two panels 1 and 1' once the coupling shown in FIG. 3 has been completed by the angling movement. The respective contact portions 26 and 34 in the shown coupled status, together create a tension force (T1) which forces the side edges 3 and 4 towards each other.

Further in the shown coupled status, the at least partially curved top surface 35 of the lower lip 32 and the passive bottom surface 27 of the sideward tongue 20 are mutually situated such that an intermediate space S is present adjacent to actively co-acting first and second contact portions 26 and 34. The passive bottom surface 27 is depicted as a substantially flat surface, but may alternatively have a concave or convex surface, as long as an amount of intermediate space S is maintained between tongue and recess in coupled status. A lower surface 36 of the upper lip 31 is at least partially inclined and configured to abut at least a part of the top surface 24 of the front region of the sideward tongue 20. The top surface 35 of the lower lip defines a deepest point 38 of the recess, wherein the shoulder 33 of the lower lip defines a highest point 39 of the lower lip, wherein said deepest point and highest point define a lower lip depth (LLD). On the upper side of the panels 1 and 1' which are forced together by the tension force from contact portions 26 and 34, a seam 40 is present which defines a vertical plane VP which subdivides the lower lip 32 into an inner lower lip part 32*i* and an outer lower lip part 320. The top surface of the shoulder part 33 is herein located at a distance from first coupling part 5, so that an intermediate space is present at this part as well.

Figure 5:
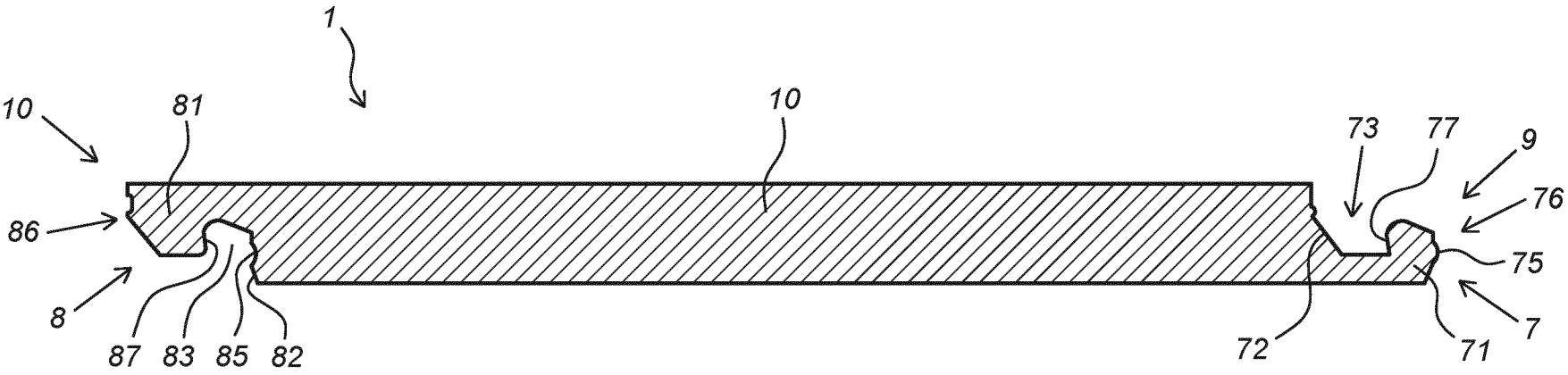
FIG. 5 shows a longitudinal cross-section along line B-B in FIG. 1 of respective side edges.

FIG. 5 shows a longitudinal cross-section of a panel 1 shown in FIG. 1, along line B-B. At side edges 9 resp. 10, a third coupling part in the form of profile 7 resp. a fourth coupling profile in the form of profile 8 is provided. The third coupling part 7 comprises an upward tongue 71, an upward flank 72 situated at a distance from the upward tongue and an upward groove 73 formed in between the upward tongue 71 and the upward flank 72, wherein the upward groove is adapted to receive at least a part of a downward tongue 81 of the fourth coupling part 8 of another panel. The side of the upward tongue 71 facing the upward flank 72 is the inside 77 of the upward tongue, and the side of the upward tongue 71 facing away from the upward flank 72 is the outside 76 of the upward tongue. A first locking element 75 is provided at an outside of the upward tongue 71 facing away from the upward flank 72. The fourth coupling part 8 comprises a downward tongue 81, a downward flank 82 situated at a distance from the downward tongue, and a downward groove 83 formed in between the downward tongue 81 and the downward flank 82, wherein the downward groove 83 is adapted to receive at least a part of the upward tongue 71 of the third coupling part 7 of another panel. The side of the downward tongue 81 facing the downward flank 82 is the inside 87 of the downward tongue and the side of the downward tongue 81 facing away from the downward flank 82 is the outside 86 of the downward tongue 81. A second locking element 85 adapted for co-action with a first locking element 75 of another panel, is provided at the downward flank 82.

Figure 6:
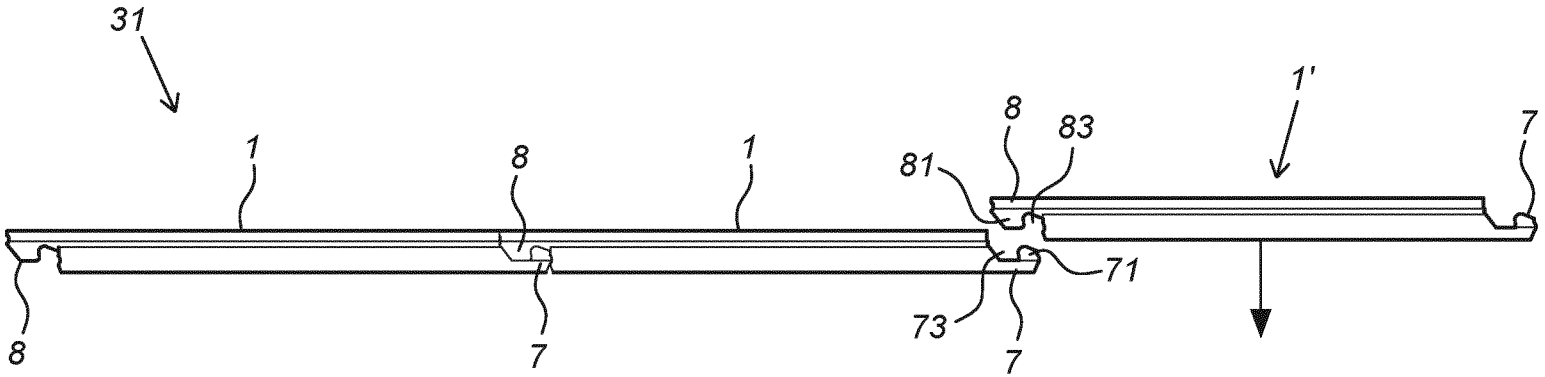
FIG. 6 shows a method of coupling of the side edges shown in FIG. 5.

FIG. 6 shows how the third and fourth coupling profiles 7 and 8 of FIG. 5 can be coupled to each other when connecting a panel 1 and a panel 1' to each other. The panel 1' is hereby moved vertically downwards along the arrow, wherein the profiles 7 and 8 engage with each other by receiving upward tongue 71 in downward groove 83 and receiving downward tongue 81 in upward groove 73.

Figure 7:
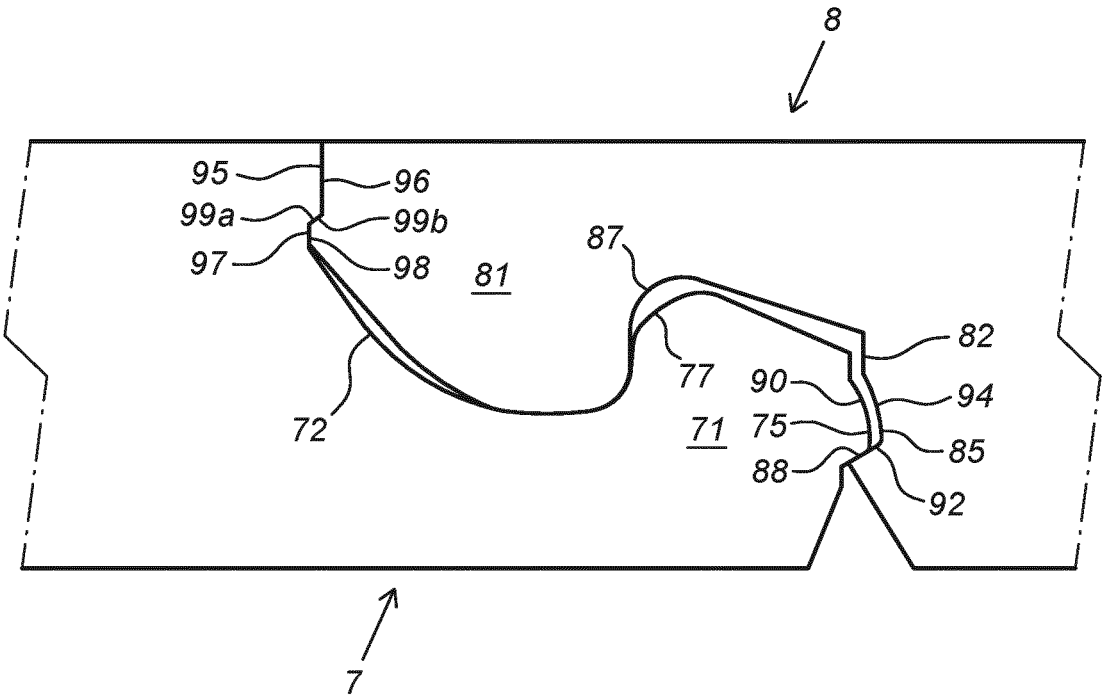
FIG. 7 shows in a longitudinal cross-section, further details of respective side edges when in coupled condition.

FIG. 7 shows in more detail the side edges 7 and 8 in coupled condition, after the coupling by vertical movement as shown in FIG. 6 has been completed. It is noted that the side edges 7 and 8 of the embodiment of FIG. 7 contain some slight adaptations over the embodiment shown in FIGS. 5 and 6, which are directly visible from the figures, and further explained below. As far as FIGS. 5-7 have the same features in common, these are indicated by the same reference numerals. The inside 77 of the upward tongue 71 is in contact with the inside 87 of the downward tongue 81 of another panel, such that the panels create a tension force (T2) which forces the side edges 7 and 8 towards each other. Part of the inside 77 of the upward tongue is inclined towards the upward flank 72, and part of the inside 87 of the downward tongue 81 is inclined towards the downward flank 82, such that the two coupled panels are interlocked in a direction perpendicular to the plane of the panels (i.e. in a vertical direction). Additionally, the first and second locking elements 75 and 85 interlock with each other, further contributing to the vertical interlocking of the coupled panels. The first locking element is a bulge 75, the second locking element is a recess 85. The bulge 75 has an upper portion 90 and an adjoining lower portion 88, wherein the lower portion 88 comprises an inclined locking surface and the upper portion 90 comprises a, preferably curved, guiding surface. The recess 85 comprises an upper portion 94 and an adjoining lower portion 92, wherein the lower portion 92 comprises an inclined locking surface.

The respective upper portions 90 and 94 are at a distance from each other, thus allowing for an intermediate space. At the upper side of the coupled side edges 7 and 8, the upper contact surfaces 95 and 96 are forced together due to the interaction of the insides 77 and 87. In addition, the respective upper contact surfaces 95 and 96 are provided with a bulge 98 and a recess 97, which interlock with each other in the coupled state. Above the bulge 98 and recess 97 respective inclined contact surfaces 99*a* and 99*b* are provided which engage with each other.

Figure 8:
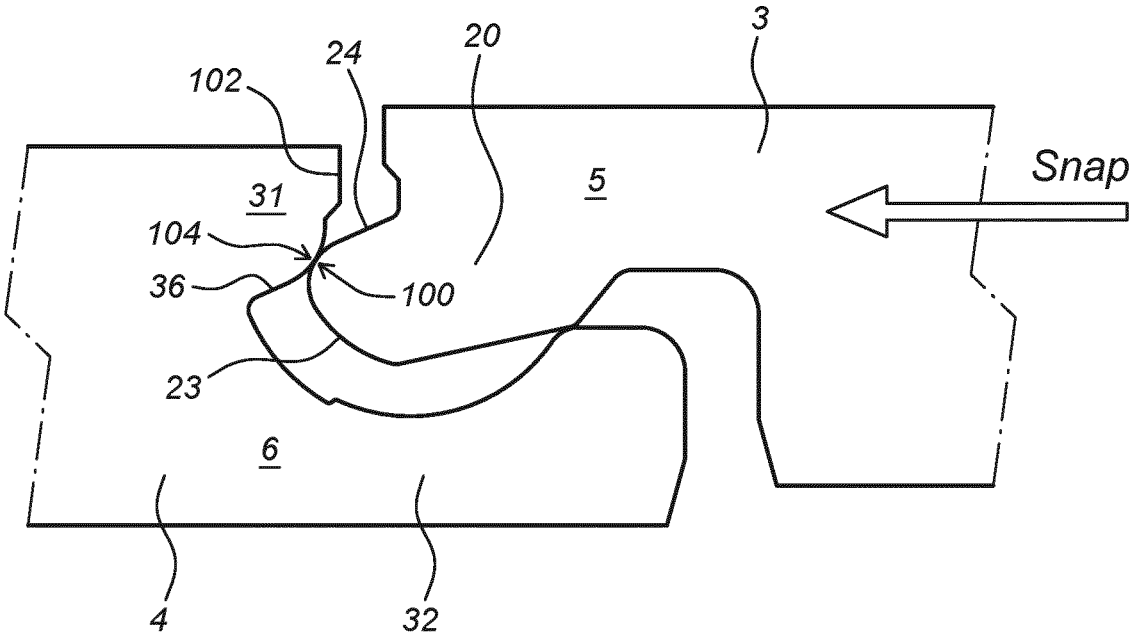
FIG. 8 shows an alternative embodiment of the side edges of FIG. 2 which allow for another method of coupling.

FIG. 8 shows an alternative embodiment of the side edges 3 and 4 according to FIG. 2, wherein the upper surface 24 of the front region 21 of the sideward tongue and a side surface 23 of the front region 21 of the sideward tongue are connected by means of a transitional convex surface 100, and the lower surface 36 of the upper lip 31 and a side surface 102 of the upper lip 31 are connected by means of a transitional convex surface 104. All other features of the side edges 3 and 4 are similar to FIG. 2. The shown embodiment allows for a coupling movement by shifting the panels towards each other in a planar direction as indicated by the arrow 'Snap'.

Figure 9:
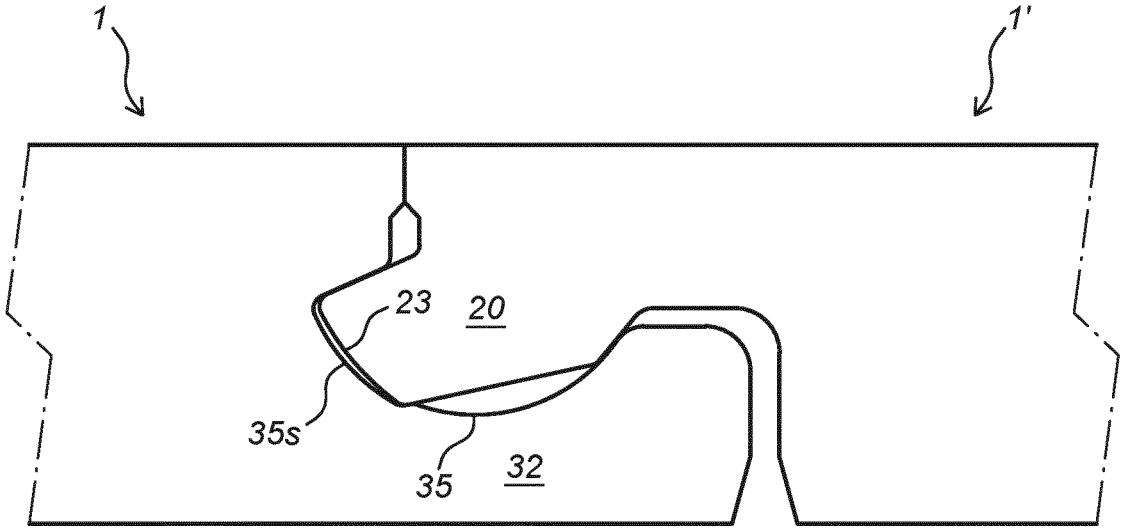
FIG. 9 shows another alternative embodiment of the side edges of FIG. 2.

FIG. 9 shows an alternative embodiment of the side edges 3 and 4 according to FIG. 2, wherein the upper surface 35 of the lower lip 32 has a staggered cut-out portion 35*s* which is complementary in size to the terminal portion 23 of the tongue 20, so that it encloses the portion 23 in a clamping way. All other features of the side edges 3 and 4 are similar to FIG. 2.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

The invention claimed is:

1. A decorative panel, comprising, at least at a first pair of opposite edges, a first coupling part and a second coupling part allowing that several of such panels can be coupled to each other, whereby the first and second coupling parts, in coupled condition of two of such panels, provide a locking in a first direction (R1) perpendicular to a plane of the panels, as well as in a second direction (R2) perpendicular to respective edges and parallel to the plane of the panels, wherein said first coupling part comprises a sideward tongue, wherein said sideward tongue comprises a front region and a back region, wherein a bottom surface and/or a side surface of said front region being rounded at least partly, wherein a top surface of the front region is at least partially inclined downwardly in a direction away from the back region, and wherein a bottom surface and/or side surface of the back region of said sideward tongue defines a first contact portion, and wherein the sideward tongue comprises a passive bottom surface situated adjacent to the first contact portion, wherein said passive bottom surface is defined by a cut-out portion at a lower side of the sideward tongue, wherein said second coupling part comprises a recess for accommodating at least a part of the sideward tongue of a further panel, said recess being defined by an upper lip and a lower lip, wherein the lower lip extends beyond the upper lip, and wherein the lower lip being provided with a upwardly protruding shoulder defining a second contact portion configured to actively co-act with said first contact portion of another panel, in coupled condition of said panels, such that that the panels are forced with a tension force (T1) at least laterally towards each other, wherein a top surface of said lower lip is smoothly curved at least partially and is configured as sliding surface for the at least partially rounded bottom surface and/or side surface of the front region of the sideward tongue of another panel during coupling, and wherein said at least partially curved top surface of the lower lip and said passive bottom surface of the sideward tongue are mutually situated such that, in coupled condition of two panels, an intermediate space is present adjacent to actively co-acting first and second contact portions, and wherein a lower surface of the upper lip is at least partially inclined and configured to abut at least a part of the top surface of the front region of the sideward tongue of another panel, wherein the bottom surface and/or side surface of the front region of the sideward tongue is configured to co-act with the lower lip in coupled condition of two panels, and together define a bottom front contact surface, wherein a seam formed by two panels in coupled condition define a vertical plane (VP), wherein said vertical plane subdivides the lower lip into an inner lower lip part and an outer lower lip lower part, and wherein an entire bottom front contact surface and the first and second contact portions are situated at the same side of the vertical plane.

2. The panel according to claim 1, wherein the passive bottom surface of the sideward tongue is substantially flat.

3. The panel according to claim 1, wherein the passive bottom surface is at least partially inclined downwardly in a direction towards the front region.

4. The panel according to claim 3, wherein the inclined top surface of the sideward tongue and the inclined passive bottom surface converge in a direction away from the back region of the sideward tongue.

5. The panel according to claim 1, wherein the top surface of the lower lip defines a deepest point of the recess, and wherein, in coupled condition of two panels, said deepest point is positioned at a distance from the passive bottom surface.

6. The panel according to claim 1, wherein the top surface of the lower lip defines a deepest point of the recess, wherein the shoulder of the lower lip defines a highest point of the lower lip, wherein said deepest point and highest point define a lower lip depth (LLD), and wherein the first and second contact portions are entirely located above half the lower lip depth.

7. The panel according to claim 1, wherein the top surface of the lower lip defines a deepest point of the recess, wherein the shoulder of the lower lip defines a highest point of the lower lip, wherein said deepest point and highest point define a lower lip depth (LLD), and wherein the smallest thickness (STD) of the sideward tongue, measured between the at least partially inclined upper surface and the passive bottom surface of the sideward tongue exceeds the lower lip depth.

8. The panel according to claim 1, wherein the first contact portion is inclined upwardly in a direction away from the front region of the sideward tongue, wherein the inclined first contact portion and the plane of the panel encloses an angle of at least 45 degrees, and wherein the second contact portion is inclined upwardly in a direction away from the upper lip, wherein the inclined second contact portion and the plane of the panel encloses an angle of at least 45 degrees.

9. The panel according to claim 1, wherein the top surface of the lower lip comprises a curved back top surface and a curved front top surface, wherein the back top surface and the front top surface are staggered with respect to each other, and wherein the front top surface is deepened with respect to the back top surface.

10. The panel according to claim 1, wherein the entire bottom front contact surface is located underneath the level of the first and second contact portions.

11. The panel according to claim 1, wherein the bottom front contact surface on one side and the contact surface defined by the first and second contact portions on the other side mutually enclose an angle of between 70 and 110 degrees, between 80 and 100 degrees.

12. The panel according to claim 1, wherein the side surface of the front region of the sideward tongue and a facing part of the top surface of the lower lip are substantially complementary shaped, and substantially complementary curved.

13. The panel according to claim 1, wherein the entire top surface of the lower lip extending in between said vertical plane (VP) and the second contact portion is a smooth curved surface.

14. The panel according to claim 1, wherein the upper surface of the lower lip is provided with a staggered cut-out portion, wherein the staggered cut-out portion is at least partially located underneath the upper lip, and which is configured to accommodate a terminal portion of the sideward tongue of another panel.

15. The panel according to claim 1, wherein the panel defines a top surface and a bottom surface defining the thickness (PT) of the panel, and wherein the thickness of the shoulder (ST), as measured from the bottom surface of the panel to the highest point of the shoulder, exceeds 30% of the panel thickness (PT).

16. The panel according to claim 1, wherein a seam formed by or in between two panels in coupled condition defines a vertical plane (VP), wherein said vertical plane subdivides the lower lip into an inner lower lip part and an outer lower lip lower part, and wherein, in coupled condition, the entire bottom surface and the entire side surface of the inner lower lip part are positioned at distance from the second coupling part.

17. The panel according to claim 1, wherein the panel comprises, at least at a further, in particular second, pair of opposite edges, a third coupling part and a fourth coupling part allowing that several of such panels can be coupled to each other by a lowering or vertical motion, whereby these coupling parts, in coupled condition of two of such panels, provide a locking in a first direction (R1) perpendicular to the plane of the panels, as well as in a second direction (R2) perpendicular to the respective edges and parallel to the plane of the panels, wherein the third coupling part comprises an upward tongue, at least one upward flank situated at a distance from the upward tongue and an upward groove formed in between the upward tongue and the upward flank, wherein the upward groove is adapted to receive at least a part of a downward tongue of the fourth coupling part of another panel, wherein the side of the upward tongue facing the upward flank is the inside of the upward tongue and the side of the upward tongue facing away from the upward flank is the outside of the upward tongue, wherein the fourth coupling part comprises a downward tongue, at least one downward flank situated at a distance from the downward tongue, and a downward groove formed in between the downward tongue and the downward flank, wherein the downward groove is adapted to receive at least a part of the upward tongue of the third coupling part of another panel, wherein the side of the downward tongue facing the downward flank is the inside of the downward tongue and the side of the downward tongue facing away from the downward flank is the outside of the downward tongue.

18. The panel according to claim 1, wherein the panel comprises at least one core layer, and at least one decorative top section, directly or indirectly affixed to said core layer, wherein the top section defines a top surface of the panel, and wherein the top section comprises a printed decorative layer, and at least one wear layer covering said printed decorative layer.

19. The panel according to claim 1, wherein the maximum distance a between the side surface of the front region of the sideward tongue and a facing part of the top surface of the lower lip is smaller than the maximum distance b between the passive bottom surface of the sideward tongue and a facing part of the top surface of the lower lip.

20. A decorative covering for a floor, ceiling or wall, which is constituted by a multitude of interconnected decorative panels according to claim 1.

* * * * *